US007551155B2

(12) United States Patent
Fukuda et al.

(10) Patent No.: US 7,551,155 B2
(45) Date of Patent: Jun. 23, 2009

(54) DISPLAY DRIVER AND ELECTRONIC INSTRUMENT

(75) Inventors: Masafumi Fukuda, Matsumoto (JP); Tadashi Yasue, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 557 days.

(21) Appl. No.: 11/075,857

(22) Filed: Mar. 10, 2005

(65) Prior Publication Data

US 2005/0212785 A1 Sep. 29, 2005

(30) Foreign Application Priority Data

Mar. 23, 2004 (JP) ..... 2004-085385

(51) Int. Cl.
*G09G 3/36* (2006.01)
*G09G 5/00* (2006.01)

(52) U.S. Cl. ..... 345/98; 345/684

(58) Field of Classification Search ..... 345/88–100, 345/204, 690, 684, 686, 688
See application file for complete search history.

(56) References Cited

U.S. PATENT DOCUMENTS 4,734,689 A * 3/1988 Kurakake ..... 345/684
5,119,086 A * 6/1992 Nishioka et al. ..... 345/89
5,909,206 A * 6/1999 Yokota et al. ..... 345/98
6,281,870 B1 8/2001 Hayashi
6,486,865 B1 * 11/2002 Ishiyama ..... 345/98
6,603,466 B1 8/2003 Sakaguchi et al.
6,801,219 B2 * 10/2004 Colavin ..... 345/684
7,176,864 B2 * 2/2007 Moriyama et al. ..... 345/100

FOREIGN PATENT DOCUMENTS

JP A 06-095615 4/1994
JP A 06-095618 4/1994
JP A 06-195043 7/1994
JP A 07-281636 10/1995
JP A 09-230834 9/1997
JP A 2001-202052 7/2001

OTHER PUBLICATIONS

U.S. Appl. No. 11/085,157, filed Mar. 22, 2005, Fukuda et al.
U.S. Appl. No. 11/075,692, filed Mar. 10, 2005, Fukuda et al.

* cited by examiner

*Primary Examiner*—Kevin M Nguyen
(74) *Attorney, Agent, or Firm*—Oliff & Berridge, PLC

(57) ABSTRACT

A display driver includes: a decoder which decodes n-bit (n is an integer greater than one) display data sequentially input from a display memory in units of n bits; a plurality of latch circuits which latch output data of the decoder; an address decoder which generates a latch pulse for the latch circuits to latch output from the decoder; and a plurality of data line driver sections. The n-bit display data is read from the display memory and input to the decoder by performing wordline control once. The decoder decodes the n-bit display data, and sequentially outputs the decoded data to the latch circuits. The address decoder outputs the latch pulse to one of the latch circuits selected based on address information on the display memory when the n-bit display data is read and storage destination designation information arbitrarily set from a control circuit.

21 Claims, 25 Drawing Sheets

| | | | FRAME NUMBER | | | |
|---|---|---|---|---|---|---|
| | | | 1 | 2 | 3 | 4 |
| GRAYSCALE DATA | 0 | 0 | 0 | 0 | 0 | 0 |
| | 0 | 1 | 1 | 0 | 0 | 1 |
| | 1 | 0 | 1 | 0 | 1 | 1 |
| | 1 | 1 | 1 | 1 | 1 | 1 |

DISPLAY DRIVER AND ELECTRONIC INSTRUMENT

Japanese Patent Application No. 2004-85385, filed on Mar. 23, 2004, is hereby incorporated by reference in its entirety.

BACKGROUND OF THE INVENTION

The present invention relates to a display driver and an electronic instrument.

In recent years, a display panel has been increasingly demanded accompanying an increase in functionality of electronic instruments. As a drive method for a display panel, various methods have been proposed. A driver circuit disclosed in Japanese Patent Application Laid-open No. 7-281636 has been known as an example. Japanese Patent Application Laid-open No. 7-281636 discloses a circuit which drives a display panel by using 10 column drivers when the display panel includes 640×480 pixels, for example. A calculation circuit is provided in each column driver. Since the calculation circuit simultaneously processes display data for 7 lines×480 columns read from a memory, the calculation circuit becomes complicated and the circuit area is increased.

Moreover, since the amount of display data is increased as the resolution of the display panel is increased, the driver circuit of the display panel also becomes complicated. If the circuit becomes complicated, manufacturing cost is increased due to an increase in the chip area and the design period. In particular, the area of the calculation circuit is considerably increased in the driver circuit disclosed in Japanese Patent Application Laid-open No. 7-281636. In the case of performing a horizontal scroll display, a right-left inversion display, or the like for the display panel using the driver circuit disclosed in Japanese Patent Application Laid-open No. 7-281636, it is necessary to rewrite the display memory each time such a display is performed.

SUMMARY

A first aspect of the present invention relates to a display driver including:

a decoder which decodes n-bit (n is an integer greater than one) display data sequentially input from a display memory in units of n bits;

a plurality of latch circuits which latch data decoded by the decoder;

an address decoder which generates a latch pulse for the latch circuits to latch output from the decoder; and a plurality of data line driver sections which drive data lines of a display panel based on the data latched by each of the latch circuits, wherein the n-bit display data is read from the display memory and output to the decoder by performing wordline control for the display memory once, wherein the decoder decodes the n-bit display data, and sequentially outputs the decoded data to the latch circuits, wherein the address decoder selects one of the latch circuits based on address information on the display memory when the n-bit display data is read and storage destination designation information arbitrarily set from a control circuit, and outputs the latch pulse to the selected one of the latch circuits, and wherein each of the data line driver sections drives corresponding one of the data lines after the decoded data has been stored in the latch circuits.

A second aspect of the present invention relates to an electronic instrument including:

the above display driver;

a display panel;

a scan driver which drives scan lines of the display panel;

a controller which controls the display driver and the scan driver; and a power supply circuit.

DETAILED DESCRIPTION OF THE EMBODIMENT

Figure 1:
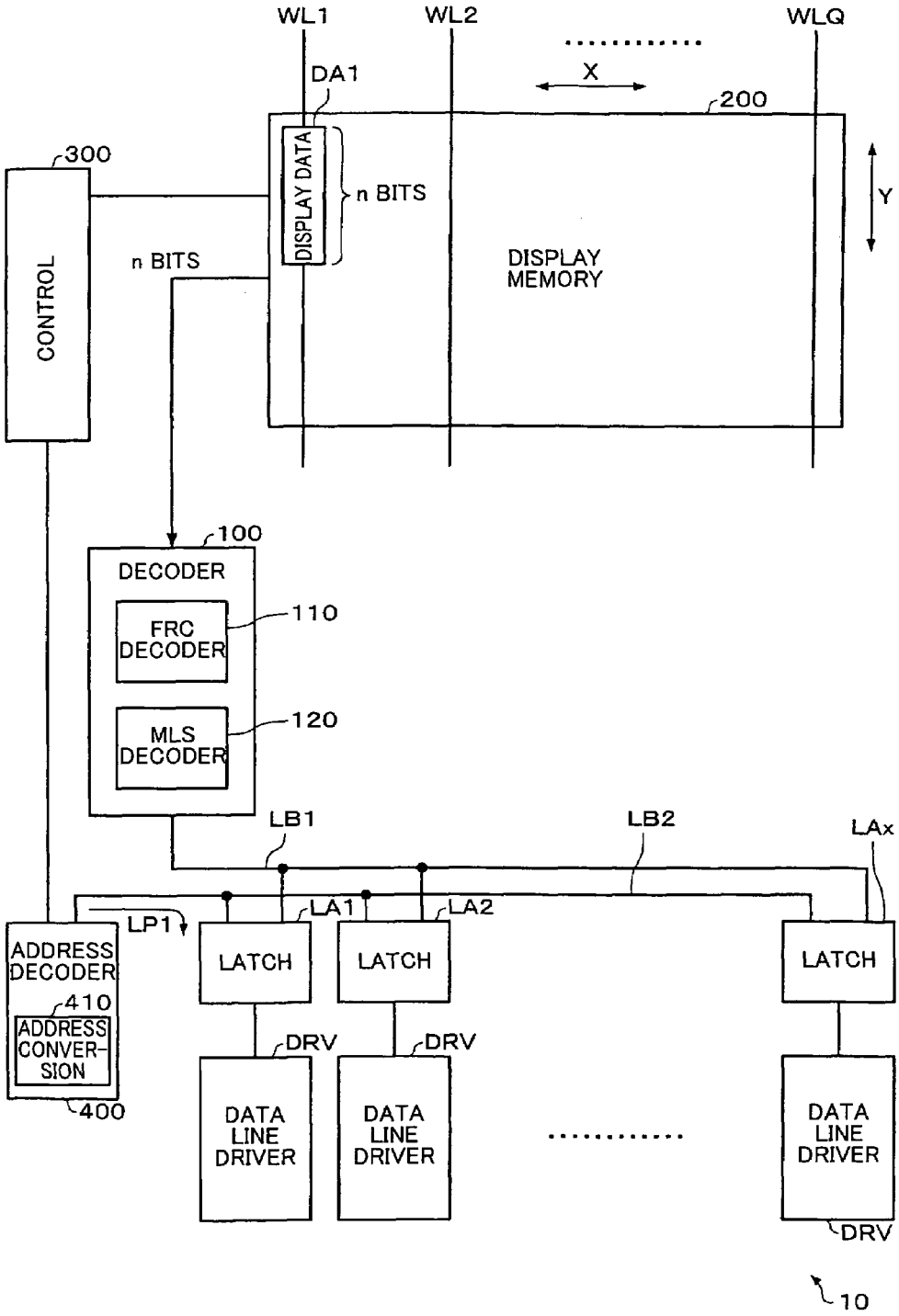
FIG. 1 is a block diagram of a display driver according to an embodiment of the present invention.

The present invention has been achieved in view of the above-described technical problem, and may provide a display driver and an electronic instrument having a small layout area, excelling in cost performance, and capable of easily processing a display such as a horizontal scroll display or a right-left inversion display.

One embodiment of the present invention provides a display driver including:

a decoder which decodes n-bit (n is an integer greater than one) display data sequentially input from a display memory in units of n bits;

a plurality of latch circuits which latch data decoded by the decoder;

an address decoder which generates a latch pulse for the latch circuits to latch output from the decoder; and a plurality of data line driver sections which drive data lines of a display panel based on the data latched by each of the latch circuits, wherein the n-bit display data is read from the display memory and output to the decoder by performing wordline control for the display memory once, wherein the decoder decodes the n-bit display data, and sequentially outputs the decoded data to the latch circuits, wherein the address decoder selects one of the latch circuits based on address information on the display memory when the n-bit display data is read and storage destination designation information arbitrarily set from a control circuit, and outputs the latch pulse to the selected one of the latch circuits, and wherein each of the data line driver sections drives corresponding one of the data lines after the decoded data has been stored in the latch circuits.

According to this embodiment, the n-bit display data is read by performing wordline control once, and the n-bit display data is decoded. It becomes unnecessary to provide a decoder for each of the data line driver sections by causing the decoder to decode the sequentially input n-bit display data and sequentially output the decoded data to the latch circuits, whereby the number of decoders can be reduced. Moreover, since the address decoder can select the latch circuit based on the address information on the display memory and the storage destination designation information from the control circuit, it is possible to cause an arbitrary latch circuit to latch the decoded data by setting the storage destination designation information.

With this display driver, the storage destination designation information may include horizontal scroll data, latch address data which indicates a storage destination of the decoded data may be set based on the address information on the display memory, the address decoder may include an address conversion circuit, the address conversion circuit may receive the horizontal scroll data and the latch address data, when horizontally scrolling an image on the display panel in a first direction, the address conversion circuit may perform addition processing of the horizontal scroll data and the latch address data, may select one of the latch circuits based on a processing result, and may output the latch pulse to the selected one of the latch circuits, and when horizontally scrolling an image on the display panel in a second direction opposite to the first direction, the address conversion circuit may perform subtraction processing of the horizontal scroll data and the latch address data, may select one of the latch circuits based on a processing result, and may output the latch pulse to the selected one of the latch circuits.

This enables a horizontal scroll display to be performed without rewriting the display data stored in the display memory.

With this display driver, the storage destination designation information may include right-left inversion data, latch address data which indicates a storage destination of the decoded data may be set based on the address information on the display memory, the address decoder may include an address conversion circuit, and the address conversion circuit may receive the right-left inversion data and the latch address data, may perform subtraction processing of the right-left inversion data and the latch address data, may select one of the latch circuits based on a processing result, and may output the latch pulse to the selected one of the latch circuits.

This enables a right-left inversion display to be performed without rewriting the display data stored in the display memory.

With this display driver, the storage destination designation information may include right-left inversion data, the address conversion circuit may receive the right-left inversion data and the latch address data, and may perform subtraction processing of the right-left inversion data and the latch address data, when performing a horizontal scroll display of an image on the display panel, the address decoder may output the latch pulse to the one of the latch circuits selected based on a result of addition processing or subtraction processing of the horizontal scroll data and the latch address data, and when performing a right-left inversion display of an image on the display panel, the address decoder may output the latch pulse to the one of the latch circuits selected based on a result of subtraction processing of the right-left inversion data and the latch address data.

This enables a horizontal scroll display or a right-left inversion display to be performed without rewriting the display data stored in the display memory.

With this display driver, the decoder may include a multi-line select drive decoder; and the multi-line select drive decoder may generate drive voltage select data for selecting a drive voltage from among a plurality of drive voltages for a multi-line select drive of scan lines based on display data for m (m is an integer greater than one) pixels included in the n-bit display data, and may output the drive voltage select data to the latch circuits.

This enables the number of multi-line select drive decoders to be smaller than the latch circuits, whereby a display driver having a small circuit area can be provided.

With this display driver, each of the data line driver sections may select a data line drive voltage from among the drive voltages based on the drive voltage select data stored in the latch circuits, and the data line driver sections may drive the data lines by using the data line drive voltage.

This enables the multi-line select drive to be performed for the display panel by storing the drive voltage select data in the latch circuits.

With this display driver, the decoder may include a grayscale decoder, and the grayscale decoder may determine a display pattern of a pixel indicated by the n-bit display data based on the n-bit display data and frame information.

This enables a grayscale representation based on the n-bit display data to be performed.

With this display driver, the grayscale decoder may output data "0" or "1" to at least one of the latch circuits based on the display pattern.

With this display driver, the decoder may further include a multi-line select drive decoder for a multi-line select drive method which simultaneously selects and drives m (m is an integer greater than one) scan lines, and the multi-line select drive decoder may output drive voltage select data for selecting a data line drive voltage for driving the data lines to the latch circuits based on the display pattern.

This enables a grayscale representation and a multi-line select drive based on the n-bit display data to be performed for the display panel.

With this display driver, each of the data line driver sections may select the data line drive voltage from among a plurality of types of drive voltages for a multi-line select drive of scan lines based on the drive voltage select data stored in one of the latch circuits, and the data line driver sections may drive the data line by using the data line drive voltage.

With this display driver, a grayscale of each of m pixels in display data extracted from the n-bit display data may be indicated by k-bit (k is an integer greater than one) grayscale data, the grayscale decoder may include a grayscale ROM for determining a grayscale pattern which indicates two types of display states based on the k-bit grayscale data and the frame information, the grayscale decoder may determine the grayscale pattern for each of the m pixels based on the grayscale ROM, and may output m-bit display data which indicates the display state of each of the m pixels by "0" or "1" based on the determined grayscale pattern to the multi-line select drive decoder, and the multi-line select drive decoder may generate the drive voltage select data based on the m-bit display data, and may output the drive voltage select data to the latch circuits.

With this display driver, the n-bit display data may be read from the display memory in synchronization with one of a rising edge and a falling edge of a clock signal from the control circuit, and the address decoder may output the latch pulse in synchronization with the other of the rising edge and the falling edge of the clock signal.

According to this embodiment, since the latch pulse output timing from the address decoder and the display data read timing from the display memory can be caused to differ according to the clock signal, the address decoder can output the latch pulse to the target latch circuit of the data decoded by the decoder.

Another embodiment of the present invention provides an electronic instrument including:

the above display driver;

a display panel;

a scan driver which drives scan lines of the display panel;

a controller which controls the display driver and the scan driver; and a power supply circuit.

The embodiments of the present invention are described below with reference to the drawings. Note that the embodiments described hereunder do not in any way limit the scope of the invention defined by the claims laid out herein. Note also that not all of the elements of these embodiments should be taken as essential requirements to the means of the present invention.

1. Display Driver

FIG. 1 is a block diagram of a display driver 10. In this embodiment, the display driver 10 includes a decoder 100, a display memory 200, a control circuit 300, an address decoder 400, a plurality of data line driver sections DRV, and a plurality of latch circuits LA1 to LAx (x is an integer greater than one).

The decoder 100 includes an FRC decoder (grayscale decoder in a broad sense) 110, and an MLS decoder (multi-line select drive decoder in a broad sense) 120. The FRC decoder 110 uses a frame rate control (FRC) method as a grayscale display method. The FRC decoder 110 in this embodiment can perform a four-grayscale representation by using 2-bit grayscale data (k-bit grayscale data in a broad sense) for each pixel. However, the present invention is not limited thereto. For example, a 16-grayscale representation may be performed by setting the data length of the grayscale data to four bits. It suffices to set the data length of the grayscale data for the FRC decoder 110 corresponding to the number of grayscales necessary for a desired grayscale representation. The MLS decoder 120 uses a multi-line select (MLS) drive method as a drive method. The MLS decoder 120 in this embodiment performs a four-line select drive of scan lines of a display panel, for example. However, the present invention is not limited thereto. For example, the number of simultaneously selected lines may be arbitrarily set, such as a three-line select drive or a five- to eight-line select drive. This embodiment can also deal with a color display, and one pixel in this embodiment may be set to one of an R pixel, a G pixel, and a B pixel in RGB color display.

Display data for displaying an image on a display panel is stored in the display memory 200. Display data DA1 is made up of n-bit data (n-bit display data in a similar sense), and is read when a wordline WL1 of the display memory 200 is selected, for example. Specifically, at least one piece of display data DA1 can be read from the display memory 200 when one wordline is selected. In this embodiment, the wordline is formed in the display memory 200 along a direction Y, for example. A plurality of wordlines WL1 to WLQ (Q is an integer greater than one) are arranged in the display memory 200 along a direction X. However, the present invention is not limited thereto. For example, the number of wordlines may be one.

The display data DA1 includes grayscale data for a plurality of pixels (m pixels in a broad sense; m is an integer greater than one), for example.

The display memory 200 receives a control signal from the control circuit 300, selects the wordline WL1 based on the control signal, and outputs the n-bit display data DA1 to the decoder 100, for example. The control signal from the control circuit 300 includes a select signal (address information on the display memory in a broad sense) which selects one of the wordlines of the display memory 200.

The decoder 100 decodes the n-bit display data DA1 read from the display memory 200.

The FRC decoder 110 decodes the grayscale data for m pixels included in the n-bit display data DA 1.

The MLS decoder 120 generates drive voltage select data based on the processing result from the FRC decoder 110, and outputs the drive voltage select data to the latch circuits LA1 to LAx. In the case where the number of simultaneously selected lines is set to four in the MLS drive method, since the number of types of voltages used in the data line driver section DRV is five, it suffices that the drive voltage select data be 3-bit data.

The address decoder 400 receives the select signal (address information on the display memory) which selects the wordline, for example. The address decoder 400 includes an address conversion circuit 410. However, the present invention is not limited thereto. The address decoder 400 may be configured to not include the address conversion circuit 410, for example. The details of the address conversion circuit 410 are described later. The address decoder 400 selects one of the latch circuits LA1 to LAx based on the select signal which selects the wordline, and outputs a latch pulse to the selected latch circuit. The latch circuit which has received the latch pulse latches the drive voltage select data. The latch pulse may be output without using the select signal (address information).

The display data DA1 is input to the decoder 100 when the wordline WL1 of the display memory 200 is selected, for example. The display data DA1 is decoded by the decoder 100, and the decoded data is output to a bus LB 1 as the drive voltage select data. The select signal which selects the wordline WL1 is output to the address decoder 400. The address decoder 400 outputs a latch pulse LP1 to the latch circuit LA1 through a bus LB2 based on the signal which selects the wordline WL1. Specifically, the latch circuit LA1 latches the drive voltage select data obtained by decoding the display data DA1. This data latch operation is performed by sequentially selecting the wordlines WL1 to WLQ.

The data line driver sections DRV drive data lines of the display panel based on the drive voltage select data stored in the latch circuits LA1 to LAx. In other drawings, sections indicated by the same symbols have the same meanings.

Figure 2:
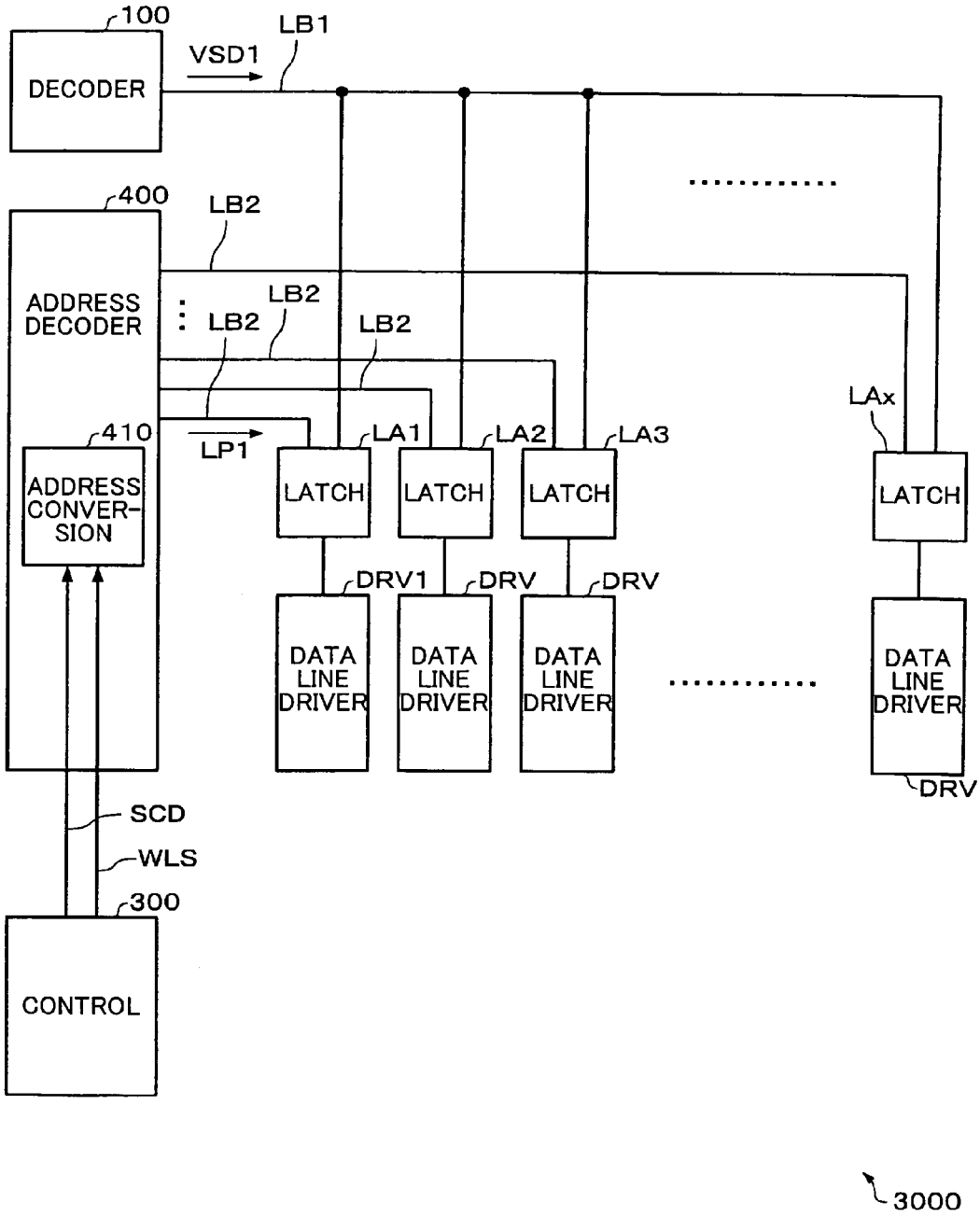
FIG. 2 shows a connection between an address decoder and a plurality of latch circuits according to this embodiment.

FIG. 2 shows a connection between the address decoder 400 and the latch circuits LA1 to LAx. The address conversion circuit 410 performs calculation processing of horizontal scroll data SCD and a wordline select signal WLS including address information on the selected wordline of the display memory 200, and selects the latch circuit based on the calculation result. The display data can be horizontally scrolled and displayed on the display panel by setting the horizontal scroll data SCD. The details of the horizontal scroll display are described later.

The address decoder 400 receives the wordline select signal WLS from the control circuit 300, and outputs the latch pulse to the latch circuit selected by the address conversion circuit 410. The address conversion circuit 410 receives the horizontal scroll data SCD from the control circuit 300 separately from the wordline select signal. The wordline address information included in the wordline select signal includes information which can designate one of the addresses assigned to the latch circuits LA1 to LAx. This information enables the address decoder 400 to obtain one of the addresses assigned to the latch circuits LA1 to LAx from the wordline address information. When the value of the horizontal scroll data SCD is "0", a normal display (display in which horizontal scroll display or right-left inversion display is not performed, for example) is performed instead of the horizontal scroll display. In more detail, when the wordline WL1 is selected, the decoder 100 outputs drive voltage select data VSD1 to the bus LB1. When the value of the horizontal scroll data SCD is "0", the address conversion circuit 410 selects the latch circuit LA1 based on the address assigned to the latch circuit LA1. The address decoder 400 outputs the latch pulse LP1 to the latch circuit LA1, whereby the drive voltage select data VSD1 is stored in the latch circuit LA1. The data line driver section DRV1 drives the data line, whereby the pixels corresponding to the display data DA1 are displayed.

Figure 3:
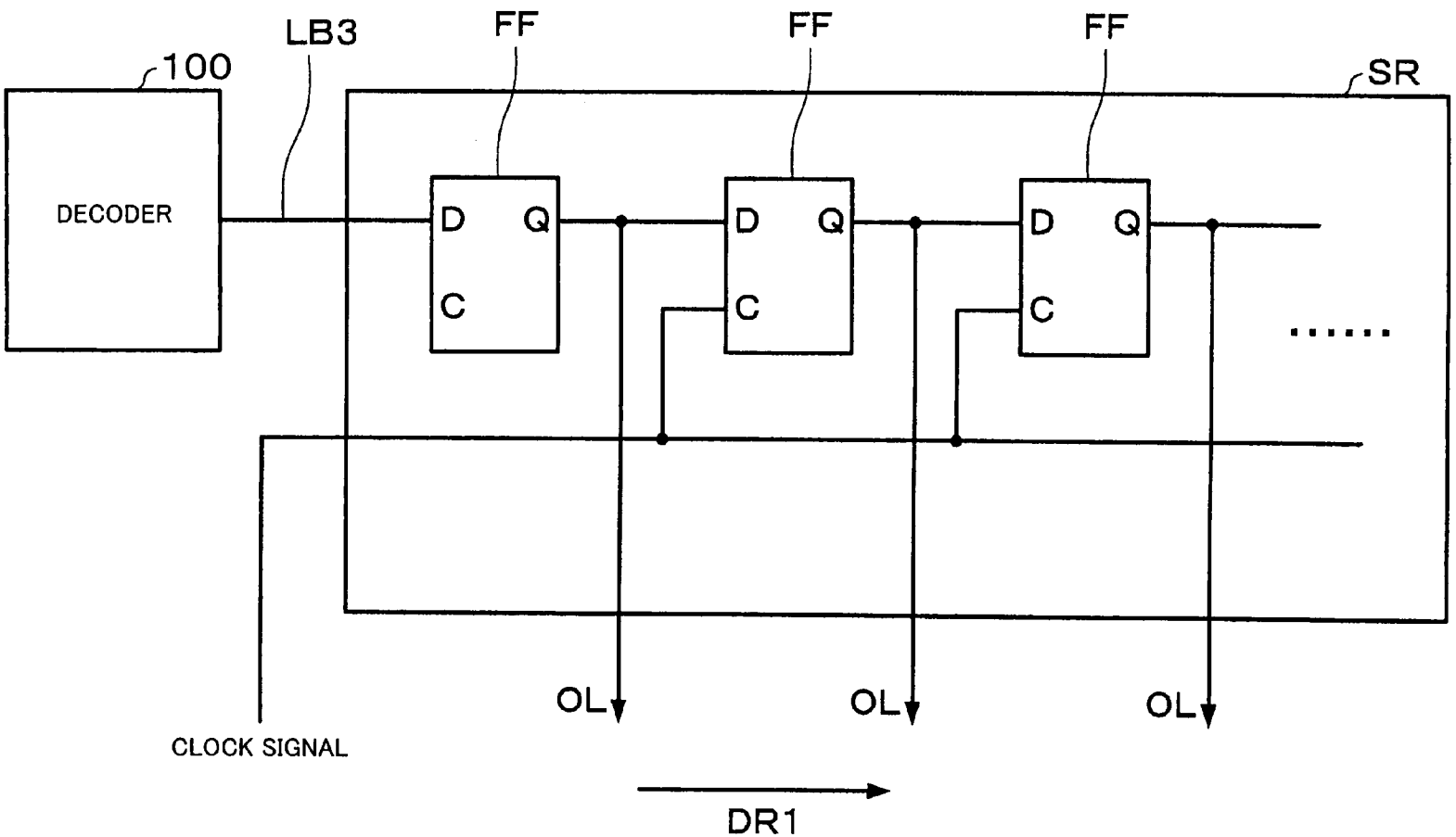
FIG. 3 shows a part of a shift register according to this embodiment.

A shift register may be used instead of the address decoder 400 and the latch circuits LA1 to LAx. FIG. 3 shows a part of a configuration of a shift register SR. The shift register SR is formed by connecting a plurality of flip-flops FF (latch circuits in a broad sense) in series. A data output Q (output terminal in a broad sense) of the flip-flop FF in the preceding stage is connected with a data input D (input terminal in a broad sense) of the flip-flop FF in the subsequent stage. The drive voltage select data is input to the shift register SR from the decoder 100 through a bus LB3. The data stored in each flip-flop FF is shifted to the right in a direction DR1 in synchronization with a clock signal input to a clock input C of each flip-flop FF. An output line OL provided between each flip-flop FF is connected with the data line driver section DRV through a line latch circuit or the like. The drive voltage select data is stored in the line latch circuit or the like by outputting the latch pulse to the line latch circuit or the like after the data for one scan line has been stored in the shift register SR. This enables the data line driver section DRV to drive the data line based on the drive voltage select data stored in the line latch circuit or the like.

Figure 4:
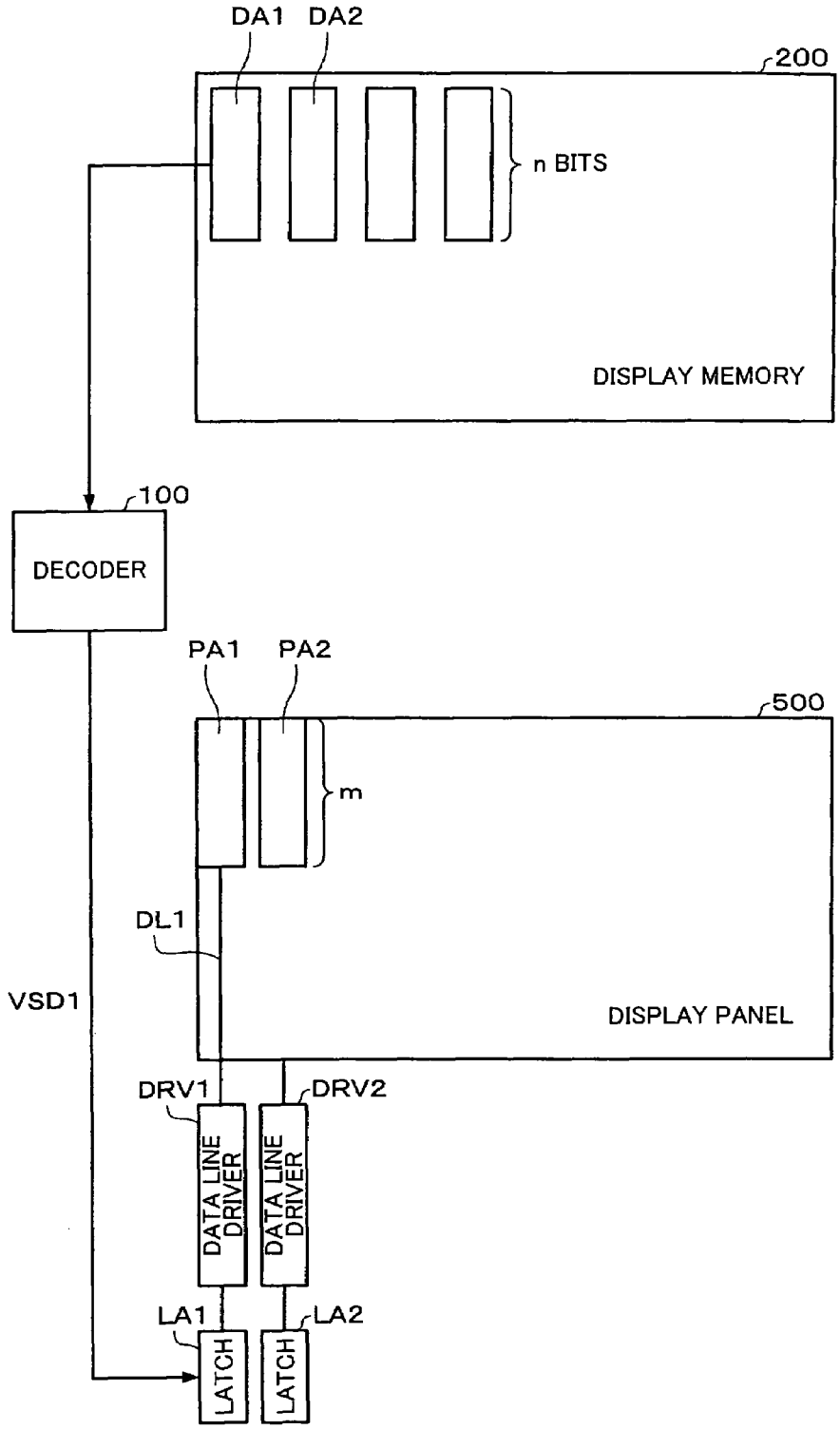
FIG. 4 shows a relationship between display data stored in a display memory according to this embodiment and pixels of a display panel.

FIG. 4 shows the relationship between the display data stored in the display memory 200 during the normal display (display in which horizontal scroll display or right-left inversion display is not performed, for example) and pixels of a display panel 500. The display data DA1 from the display memory 200 is decoded by the decoder 100. During the normal display, the decoded data is stored in the latch circuit LA1 as the drive voltage select data VSD1. The data line driver section DRV 1 drives the data line DL1 based on the drive voltage select data VSD1. In this case, simultaneously selected m pixels PA1 are voltage-controlled through the data line DL1. Specifically, the display data DA1 in the display memory 200 corresponds to the m pixels PA1 of the display panel 500. Likewise, display data DA2 in the display memory 200 corresponds to m pixels PA2 of the display panel 500.

In the case of using k-bit (k is an integer of one or more) grayscale data for one pixel, the n-bit display data DA1 obtained by selecting the wordline WL1 is made up of (k×m) bits in order to display the m pixels PA1. Specifically, (k×m)-bit display data is output to the decoder 100 by selecting one wordline of the display memory 200, and decode processing for displaying the m pixels on the display panel 500 is performed by the decoder 100.

2. Decoder

Figure 5:
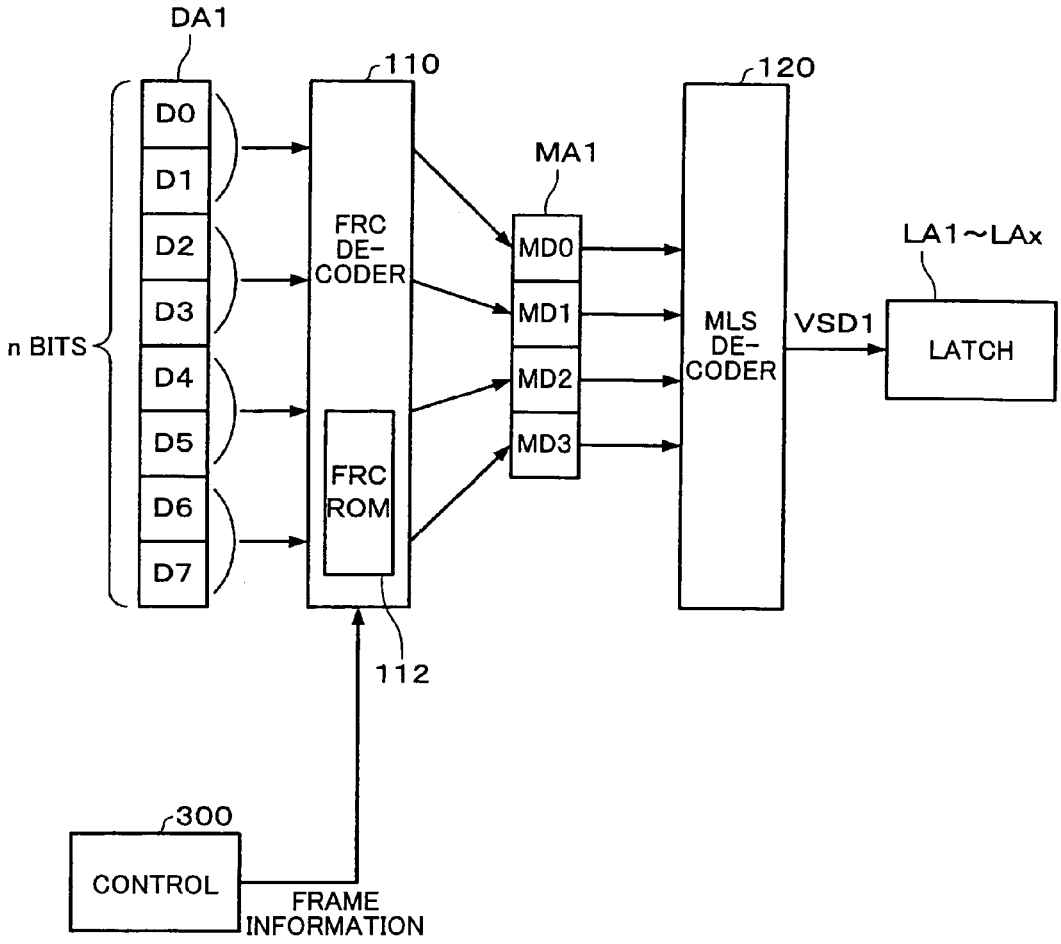
FIG. 5 is a block diagram illustrative of operations of an FRC decoder and an MLS decoder.

FIG. 5 is a block diagram illustrative of the operations of the FRC decoder 110 and the MLS decoder 120. FIG. 5 shows the case where the n-bit display data is the 8-bit display data DA1, for example. Symbols D0 to D7 indicate data of each bit of the 8-bit display data DA1. Since the decoder 100 in this embodiment uses a four-grayscale representation and a four-line select drive method (simultaneous multi-line select drive method which simultaneously selects and drives m scan lines in a broad sense), the 8-bit display data DA1 includes display data for four pixels, and the grayscale of each of the four pixels is indicated by 2-bit grayscale data. The target four pixels of the 8-bit display data DA1 are called first to fourth pixels. Specifically, the data D0 and D1 of the display data DA1 is the grayscale data for the first pixel, and the data D2 and D3 is the grayscale data for the second pixel. The data D4 to D7 of the display data DA1 is the grayscale data for the third and fourth pixels.

The 8-bit display data DA1 is decoded by the FRC decoder 110. The FRC decoder 110 includes an FRCROM 112 (grayscale ROM in a broad sense). However, the present invention is not limited thereto. The FRC decoder 110 receives frame information from the control circuit 300. A frame number when the display data DA1 is decoded is included in the frame information. The FRCROM 112 is a storage circuit which stores a display pattern table for determining 1-bit data (display pattern in a broad sense) for each pixel based on the frame number and the pixel grayscale data.

The FRC decoder 110 outputs 4-bit (m-bit in a broad sense) display data MA1 (display data for m pixels in a broad sense) from the frame information and the grayscale data D0 to D7 for the first to fourth pixels based on the display pattern table (see FIG. 7) stored in the FRCROM 112. In FIG. 5, symbols MD0 to MD3 indicate data of each bit of the display data MA1.

The MLS decoder 120 generates the drive voltage select data VSD1 by decoding the 4-bit display data MA1, and outputs the drive voltage select data VSD1 to the latch circuits LA1 to LAx. The drive voltage select data VSD1 is latched by the latch circuit LA1 among the latch circuits LA1 to LAx which has received the latch pulse LP1 from the address decoder 400, for example.

Figure 6:
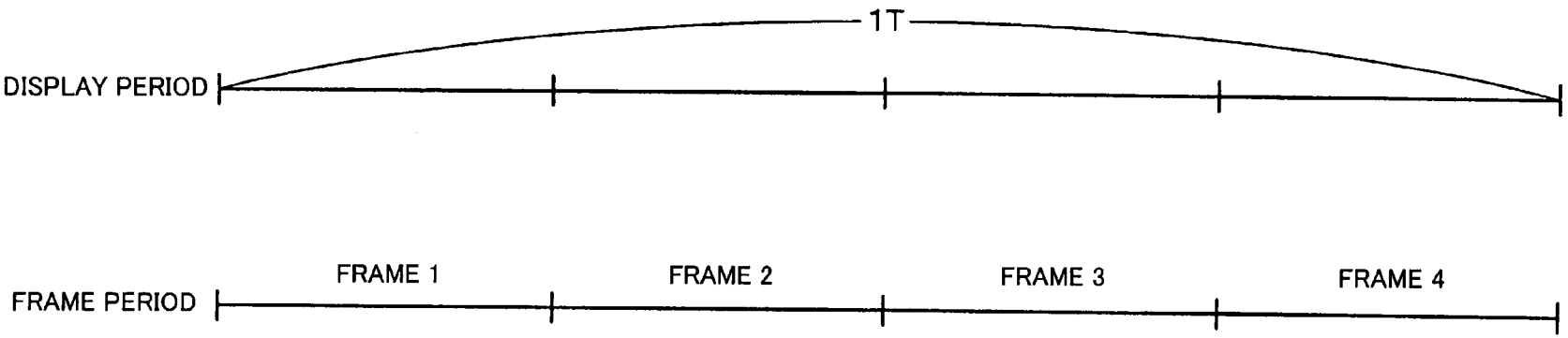
FIG. 6 shows a relationship among a display period, a frame period, and a field period according to this embodiment.

In the FRC grayscale method (frame grayscale method), when a display period in which one frame is displayed is a display period IT, the display period IT is divided into a plurality of frame periods, and whether or not to display a pixel is controlled in each frame period. The FRC grayscale method realizes a grayscale representation by adjusting the number of frame periods in which a pixel is displayed. The frame number included in the above-mentioned frame information is a number for alternatively indicating each frame period. FIG. 6 shows an example in which the display period IT is divided into four frame periods. In the case of performing a four-grayscale representation, when the 2-bit grayscale data is (11), a pixel is displayed in all of frame periods 1 to 4 shown in FIG. 6, for example. When the 2-bit grayscale data is (01), a pixel is displayed in one of the frame periods 1 to 4 shown in FIG. 6, for example.

Since the four-line select drive is performed in this embodiment, the data decoded by the FRC decoder 110 is decoded by the MLS decoder 120, for example. In this case, each of the frame periods 1 to 4 includes four field periods F1 to F4. The drive voltage select data is generated in each field period based on the data decoded by the FRC decoder 110 in each frame period, whereby the four-line select drive is performed.

Figures 7, 8:
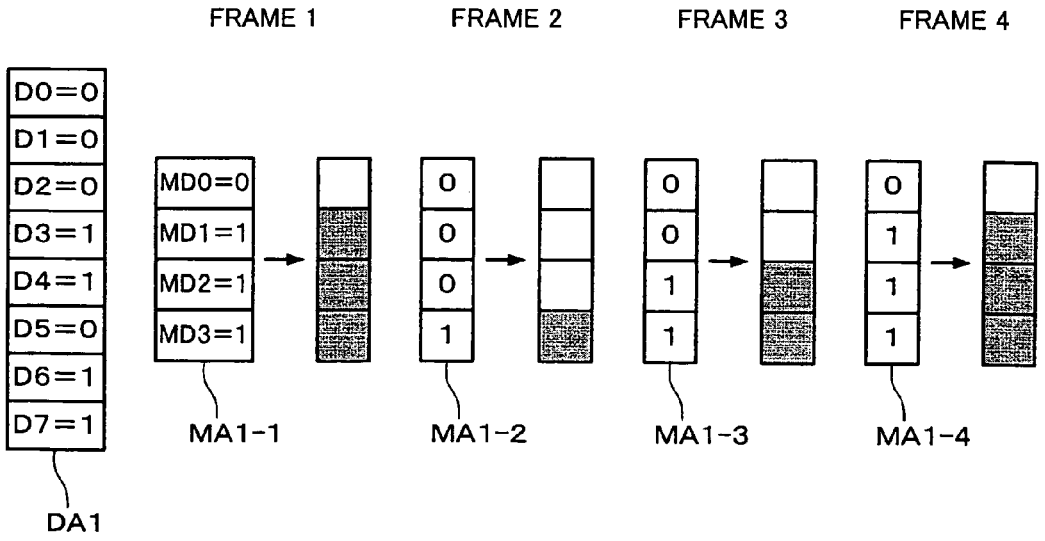
FIG. 7 shows an example of a display pattern table according to this embodiment.
FIG. 8 is illustrative of an operation of an FRC decoder according to this embodiment.

FIG. 7 shows an example of the display pattern table. The FRC decoder 110 outputs the display data MA1 according to the display pattern table stored in the FRCROM 112. The display pattern table is a table for determining a 1-bit value based on the frame number and the grayscale data as shown in FIG. 7, for example. When decoding the display data in the frame period 1 shown in FIG. 6, specifically, when the frame number is "1", a value "0" is output for the pixel grayscale data (00). When the frame number is "4", a value "0" is output for the pixel grayscale data (00), and a value "1" is output for the pixel grayscale data (10).

Display data MA1-1 to MA1-4 shown in FIG. 8 indicates the display data MA1 which is decoded and output in each frame period when the values of the data D0 to D7 of the display data DA1 are (00011011), for example. In the frame period 1, the values of the data MD0 to MD3 of the display data MA1-1 are decoded and output as (0111) according to the display pattern table shown in FIG. 7. In the frame period 2, the values of the data MD0 to MD3 of the display data MA1-2 are output as (0001). Likewise, the values of the data MD0 to MD3 of the display data MA1-3 and MA1-4 are output as (0011) and (0111), respectively.

FIG. 8 shows that a pixel is displayed when the value of each piece of data of the display data is "1", and a pixel is displayed when the value of each piece of data is "0". However, "1" and "0" may be reversed.

A flow in which the n-bit display data from the display memory 200 is sequentially decoded and the drive voltage select data is output to the latch circuits LA1 to LAx is described below using FIGS. 9 and 10.

Figure 9:
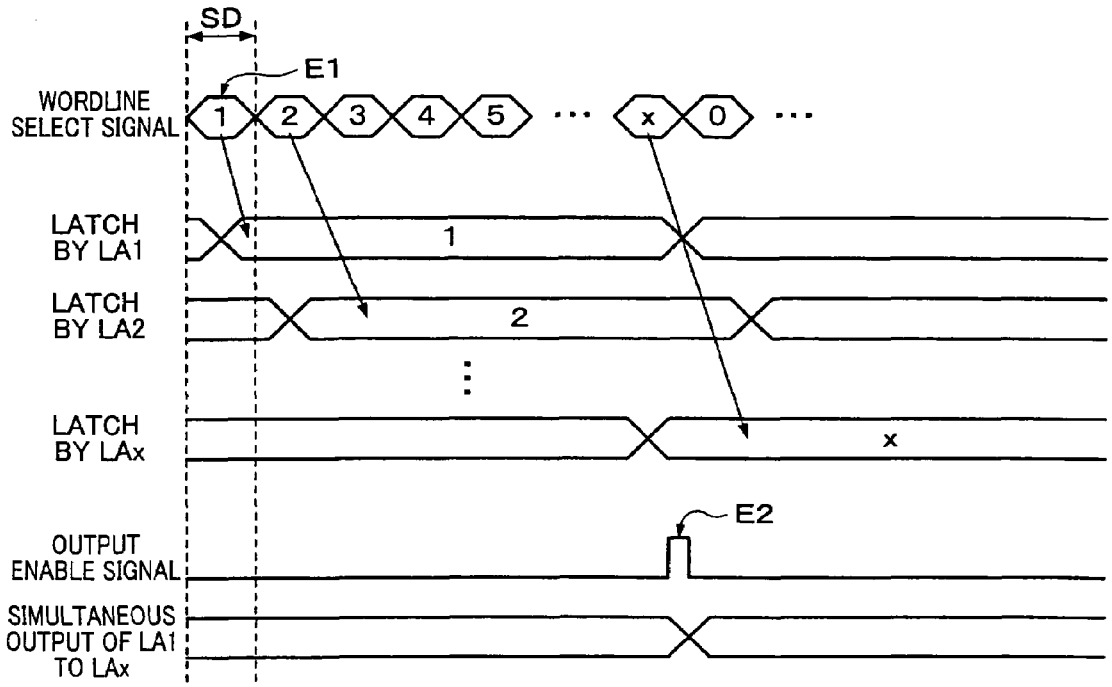
FIG. 9 is a timing chart when a latch pulse is input to a latch circuit according to this embodiment.

FIG. 9 is a timing chart when the latch pulse is input to the latch circuits LA1 to LAx during the normal display. A wordline select signal is the select signal (address information on the display memory in a broad sense) for selecting one of the wordlines of the display memory 200. The drive voltage select data is latched by the latch circuit LA1 based on the wordline select signal indicated by a symbol E1. The wordlines WL1 to WLQ of the display memory 200 are sequentially selected, whereby the drive voltage select data is latched by the latch circuits LA1 to LAx. After the drive voltage select data has been latched by the latch circuits LA1 to LAx, an output enable signal indicated by a symbol E2 is output to the data line driver sections DRV, and the data lines are driven by the data line driver sections DRV.

Figure 10:
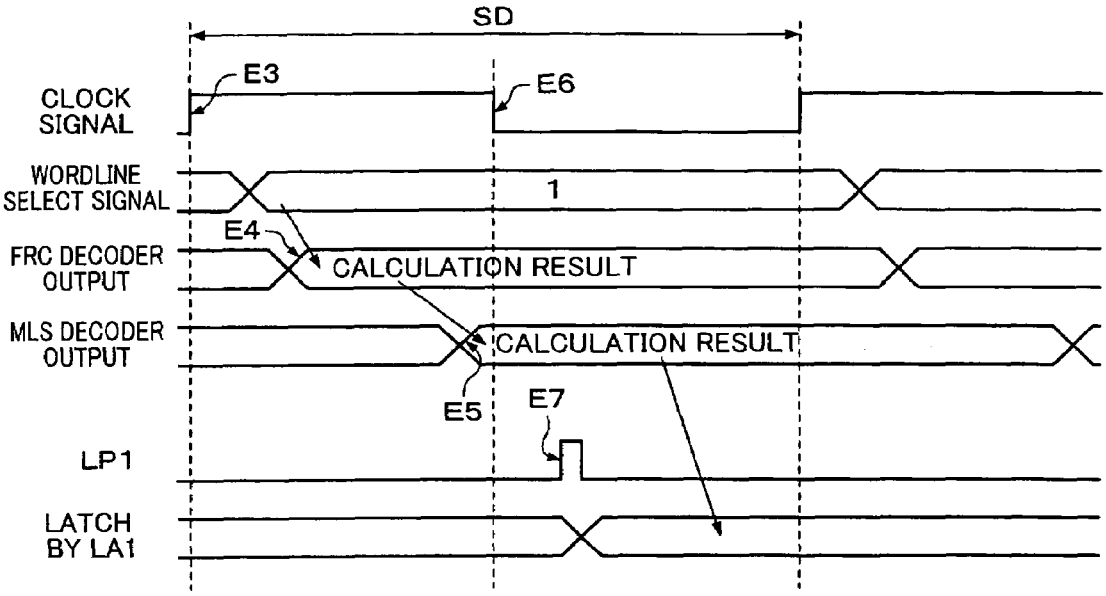
FIG. 10 is a timing chart showing details of a part of the period shown in FIG. 9.

FIG. 10 is an enlarged timing chart of the period indicated by a symbol SD shown in FIG. 9. The period SD corresponds to one cycle of the clock signal, for example. The wordline select signal is output from the control circuit 300 to the display memory 200 in synchronization with the rising edge of the clock signal indicated by a symbol E3. In the display memory 200, the wordline WL1 is selected based on the wordline select signal, for example. The display data DA1 is input to the FRC decoder 110 at the timing indicated by a symbol E4 and is decoded by the FRC decoder 110, for example. The data decoded by the FRC decoder 110 is input to the MLS decoder 120 at the timing indicated by a symbol E5 and is decoded by the MLS decoder 120, for example. The data decoded by the MLS decoder 120 is output to the latch circuits LA1 to LAx as the drive voltage select data VSD1, for example.

The latch pulse LP1 indicated by a symbol E7 is output to the latch circuit LA1 from the address decoder 400 in synchronization with the falling edge of the clock signal indicated by a symbol E6, for example. This enables the latch circuit LA1 to latch the drive voltage select data VSD1 generated by the MLS decoder 120.

The MLS decoder 120 has decoded the data output from the FRC decoder 110 in a period before the falling edge of the clock signal indicated by the symbol E6. Therefore, the MLS decoder 120 can output the drive voltage select data VSD1 at the timing of the falling edge of the clock signal indicated by the symbol E6.

The wordline select signal is output in synchronization with the rising edge of the clock signal, and the latch pulse LP1 is output in synchronization with the falling edge of the clock signal, for example. However, the present invention is not limited thereto. The wordline select signal may be output in synchronization with the falling edge of the clock signal, and the latch pulse LP1 may be output in synchronization with the rising edge of the clock signal, for example.

The wordline select signal may be output in synchronization with the rising edge of the clock signal, and the latch pulse LP1 may not be output in synchronization with the falling edge of the clock signal and may be generated after securing a period of time sufficient for the processing of the FRC decoder 110 and the MLS decoder 120 from the same rising edge of the clock signal as the wordline select signal by using a delay circuit, for example.

A feature that the rising/falling edge of the clock signal is in synchronization with the rising/falling edge of another signal includes the case where the time difference between the rising/falling edge of the clock signal and the rising/falling edge of another signal is uniform, and also includes the case where the rising/falling edge of another signal is set at the same time as the falling edge of the clock signal.

3. Address Decoder

Figure 11:
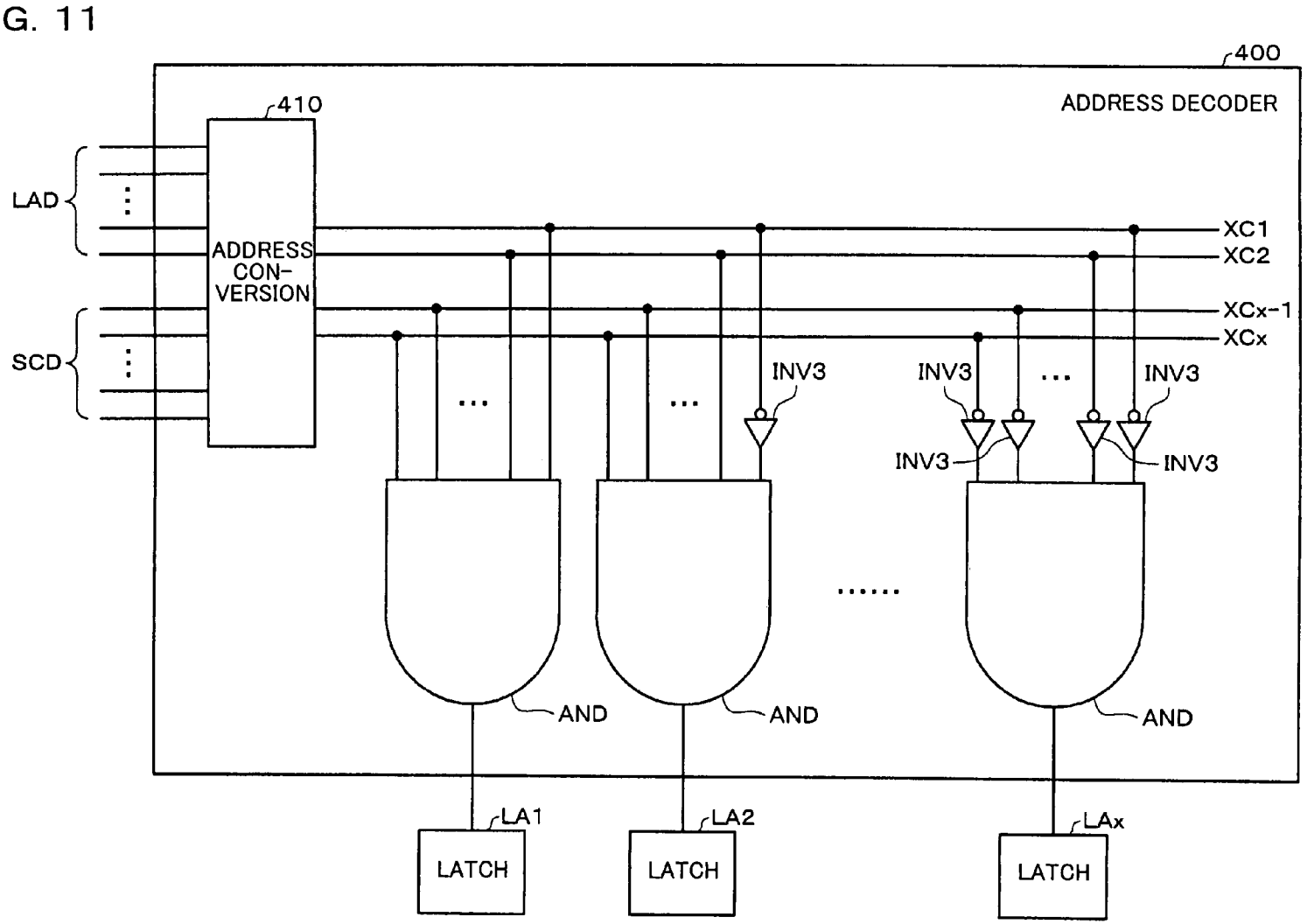
FIG. 11 shows an address decoder according to this embodiment.

The address decoder 400 shown in FIG. 11 includes the address conversion circuit 410, for example. This enables a horizontal scroll display or a right-left inversion display to be performed for the display panel without rewriting the display data written into the display memory 200.

A horizontal scroll display is described below. Latch address data LAD indicates data of the address assigned to the latch circuit. The address decoder 400 can obtain one of the addresses assigned to the latch circuits LA1 to LAx by receiving the wordline address information. The address conversion circuit 410 performs calculation processing of the latch address data LAD and the horizontal scroll data SCD. When each bit of the calculation result data is indicated by C1 to Cx, the address conversion circuit 410 outputs data XC1 to XCx obtained by reversing the data C1 to Cx to a plurality of logic circuits AND. Each logic circuit AND includes at least x inputs. Inverters INV3 are provided to each logic circuit AND in the exclusive combination so that each logic circuit AND which has received the data XC1 to XCx from the address conversion circuit 410 exclusively outputs a true value (value "1" or high-level signal, for example). The output of each logic circuit AND is connected with the latch circuits LA1 to LAx. Therefore, the latch circuits LA1 to LAx can exclusively receive the latch pulse.

Figure 12:
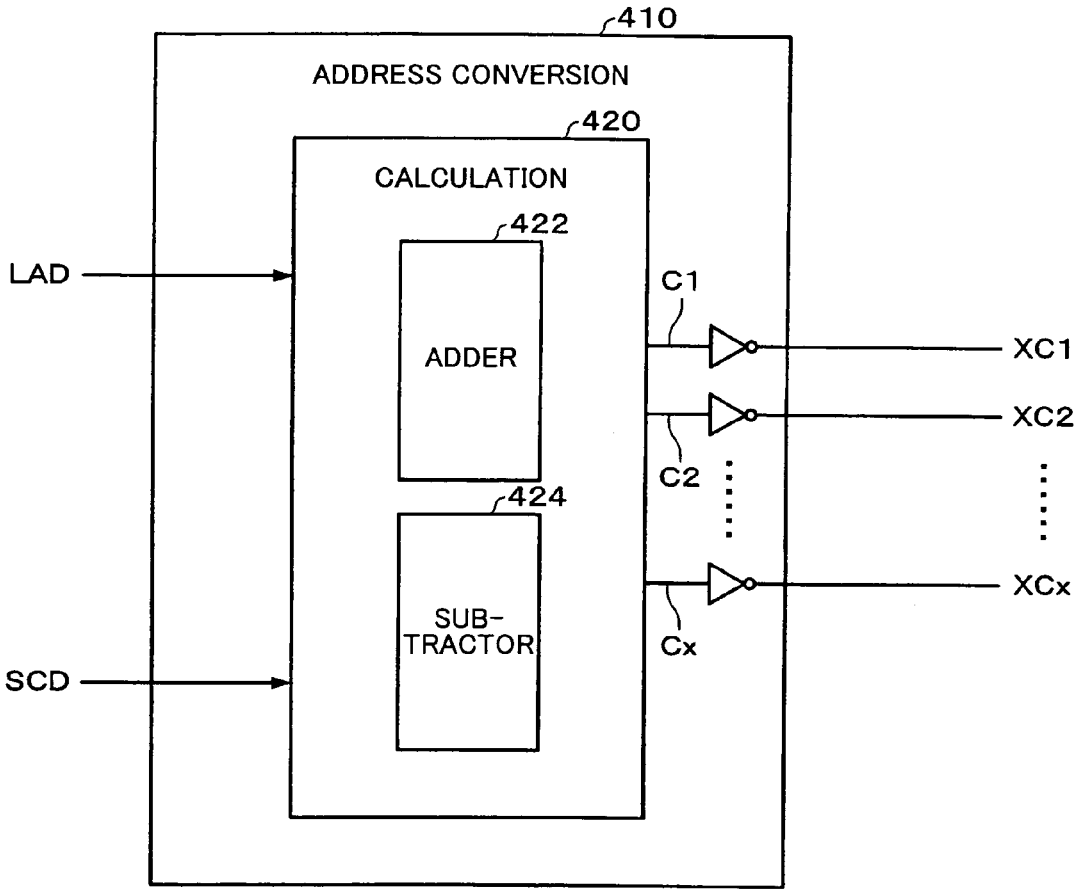
FIG. 12 shows an address conversion circuit according to this embodiment.

FIG. 12 shows the address conversion circuit 410. The address conversion circuit 410 includes a calculation circuit 420. The calculation circuit 420 includes an adder circuit 422 and a subtractor circuit 424. However, the present invention is not limited thereto. The adder circuit 422 or the subtractor circuit 424 may be omitted. The address conversion circuit 410 which has received the latch address data LAD and the horizontal scroll data SCD performs calculation processing using the calculation circuit 420. The calculation circuit 420 performs addition processing or subtraction processing of the latch address data LAD and the horizontal scroll data SCD. When performing addition processing, the adder circuit 422 adds the latch address data LAD to the horizontal scroll data SCD, for example. When performing subtraction processing, the subtractor circuit 424 subtracts the horizontal scroll data SCD from the latch address data LAD, for example. The addition result or the subtraction result is output as the output data from the calculation circuit 420. The data C1 to Cx of each bit of the output data from the calculation circuit 420 is reversed by inverters or the like, and output as the data XC1 to XCx.

Figure 13:
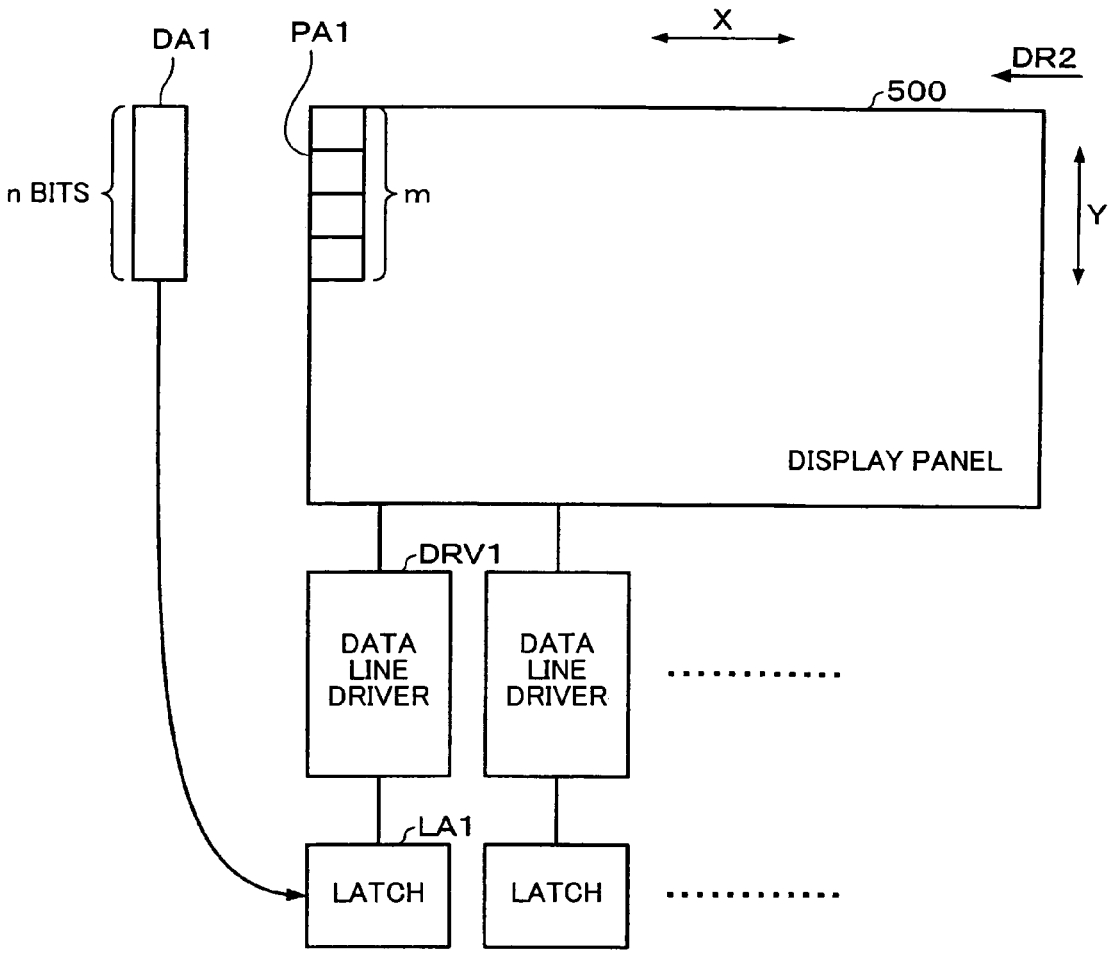
FIG. 13 is illustrative of a horizontal scroll display according to this embodiment.

A flow of the horizontal scroll display is described below using FIGS. 13 to 16. FIG. 13 shows m pixels PA1 displayed using the n-bit display data DA1 when the value of the horizontal scroll data SCD is "0", for example. The horizontal scroll data SCD is set to "0" when not performing the horizontal scroll display, for example. This allows the latch pulse to be output to the latch circuit LA1 according to the latch address data LAD, whereby the n-bit display data DA1 is decoded by the decoder 100 and is latched by the latch circuit LA1. Specifically, the data line is driven by the data line driver section DRV1, whereby the m pixels PA1 of the display panel 500 are displayed.

Figure 14:
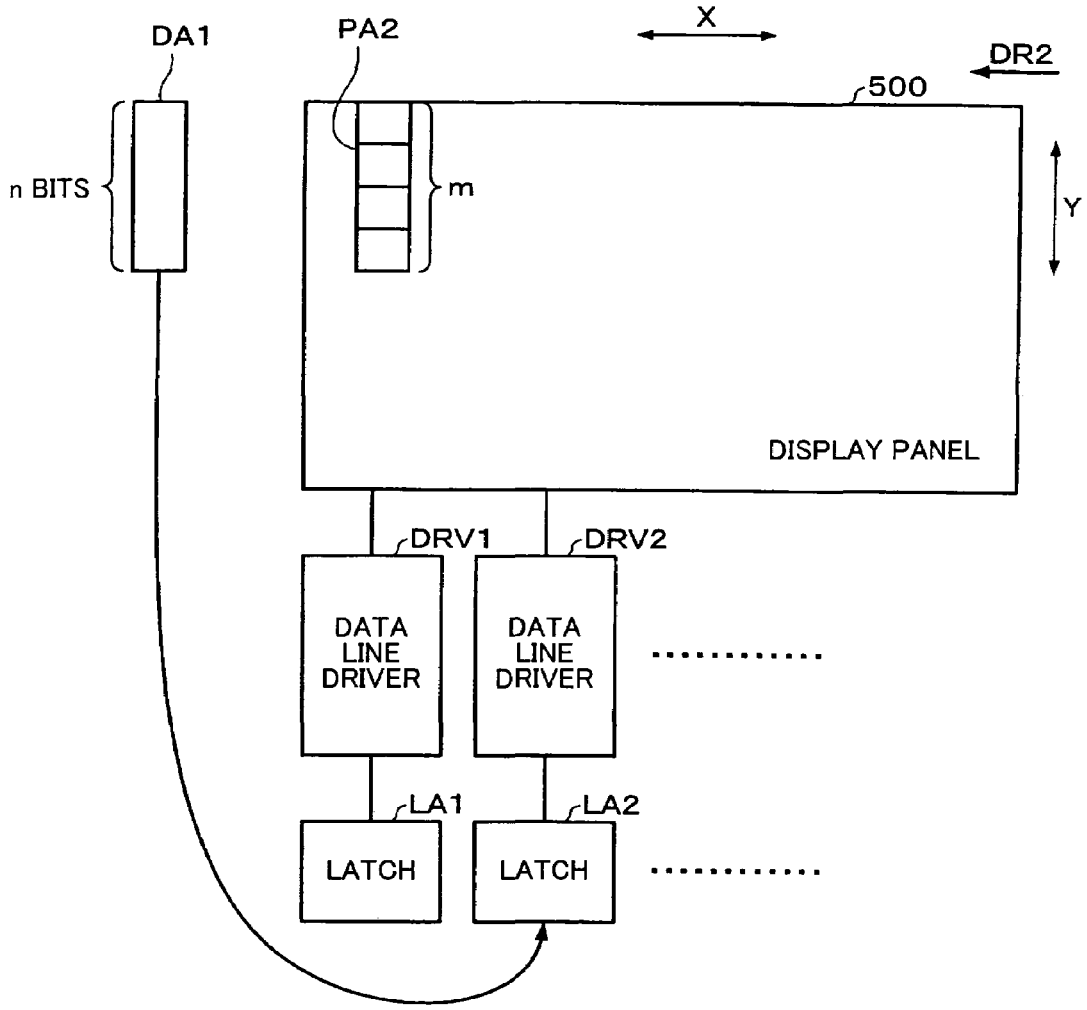
FIG. 14 is illustrative of a horizontal scroll display according to this embodiment.

FIG. 14 shows the case of performing the horizontal scroll display for one pixel in a right direction DR2 (first direction in a broad sense) along the direction X. In the case of performing the horizontal scroll display for one pixel in the direction DR2, the horizontal scroll data SCD is set to "1", for example. The calculation circuit 420 shown in FIG. 12 performs addition processing of the latch address data LAD and the horizontal scroll data SCD, for example. This causes the output from the address conversion circuit 410 to be data indicating the latch circuit LA2 differing from FIG. 13. The address decoder 400 outputs the latch pulse to the latch circuit LA2 according to the output from the address conversion circuit 410. This causes the n-bit display data DA1 to be decoded by the decoder 100 and latched by the latch circuit LA2. Specifically, the data line driver section DRV2 drives the data line, whereby m pixels PA2 are displayed. Specifically, as is clear from the comparison between the m pixels PA1 shown in FIG. 13 and the m pixels PA2 shown in FIG. 14, the horizontal scroll display for one pixel to the right along the direction X can be performed by setting the value of the horizontal scroll data SCD to "1".

Figure 15:
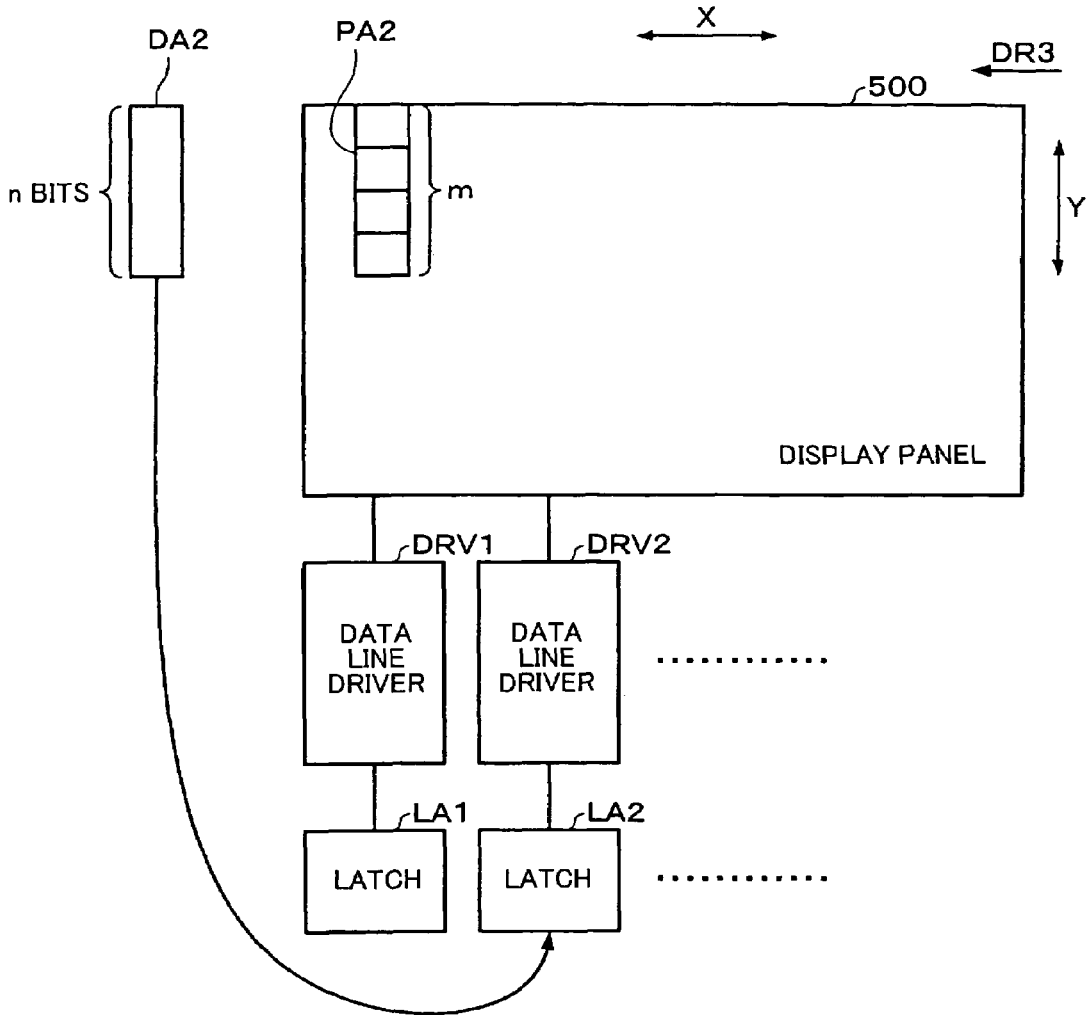
FIG. 15 is illustrative of a horizontal scroll display according to this embodiment.

FIG. 15 shows the m pixels PA2 displayed by the n-bit display data DA2 when the value of the horizontal scroll data SCD is "0", for example. The n-bit display data DA2 is the display data which is output when the wordline WL2 of the display memory 200 shown in FIG. 1 is selected, for example. In this case, the address decoder 400 obtains the latch address data LAD assigned to the latch circuit LA2 from the wordline address information when the wordline WL2 is selected. Specifically, since the address decoder 400 outputs the latch pulse to the latch circuit LA2 when the value of the horizontal scroll data SCD is "0", the n-bit display data DA2 is decoded by the decoder 100 and latched by the latch circuit LA2. This causes the data line driver section DRV2 to drive the data line, whereby the m pixels PA2 of the display panel 500 are displayed.

Figure 16:
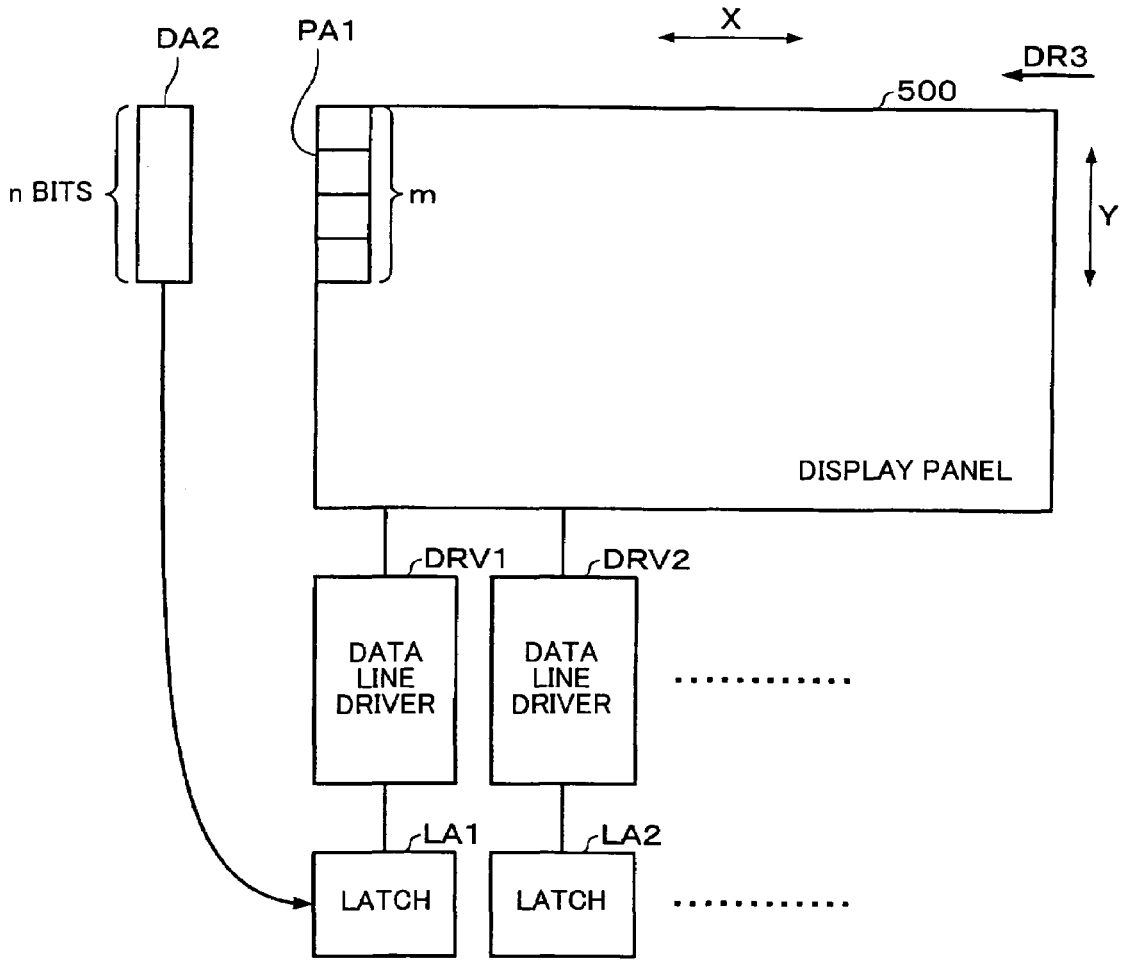
FIG. 16 is illustrative of a horizontal scroll display according to this embodiment.

FIG. 16 shows the case of performing the horizontal scroll display of the n-bit display data DA2 for one pixel in a left direction DR3 (second direction in a broad sense) along the direction X. In the case of performing the horizontal scroll display for one pixel in the direction DR3, the horizontal scroll data SCD is set to "1", for example. The calculation circuit 420 shown in FIG. 12 subtracts the horizontal scroll data SCD from the latch address data LAD, for example. This causes the output from the address conversion circuit 410 to be data indicating the latch circuit LA1 differing from FIG. 15. The address decoder 400 outputs the latch pulse to the latch circuit LA1 according to the output from the address conversion circuit 410. This causes the n-bit display data DA2 to be decoded by the decoder 100 and latched by the latch circuit LA1. Specifically, the data line driver section DRV1 drives the data line, whereby the m pixels PA1 are displayed.

The above description is not limited to the horizontal scroll display for one pixel. In the case of performing the horizontal scroll display for two pixels to the right or left along the direction X, the horizontal scroll data SCD is set to "2", for example. In the case where the number of data lines is 64, the number of data lines can be indicated by six bits. In this case, the latch address data LAD corresponding to the display data DA2 may be expressed by (000001), for example. The horizontal scroll data SCD of the horizontal scroll display for two pixels may be expressed by (000010), for example. In this case, when the calculation circuit 420 shown in FIG. 12 subtracts the horizontal scroll data SCD from the display data DA2, (000001)−(000010)=(000001)+(111110)=(111111) is obtained by using two's complement notation. In the case where the leftmost data line in the direction X is the first data line, (111111) is the address assigned to the latch circuit corresponding to the rightmost data line in the direction X. Specifically, when performing the horizontal scroll display of certain display data, the rightmost data line in the direction X is driven after driving the leftmost data line in the direction X. The leftmost data line in the direction X may be driven after driving the rightmost data line in the direction X.

Specifically, when performing the horizontal scroll display for ss (ss is an integer of one or more) pixels to the right or left along the direction X, the value of the horizontal scroll data SCD is set to ss, for example.

When performing the horizontal scroll display to the right along the direction X, the value of the horizontal scroll data SCD may be set to "−1", and the calculation circuit 420 may perform subtraction processing. Specifically, the horizontal scroll display to the right along the direction X can be performed by setting the value of the horizontal scroll data SCD to a negative value and performing subtraction processing using the calculation circuit 420. When performing the horizontal scroll display to the left along the direction X, the value of the horizontal scroll data SCD may be set to "−1", and the calculation circuit 420 may perform addition processing. Specifically, the horizontal scroll display to the left along the direction X can be performed by setting the value of the horizontal scroll data SCD to a negative value and performing addition processing using the calculation circuit 420.

Figure 17:
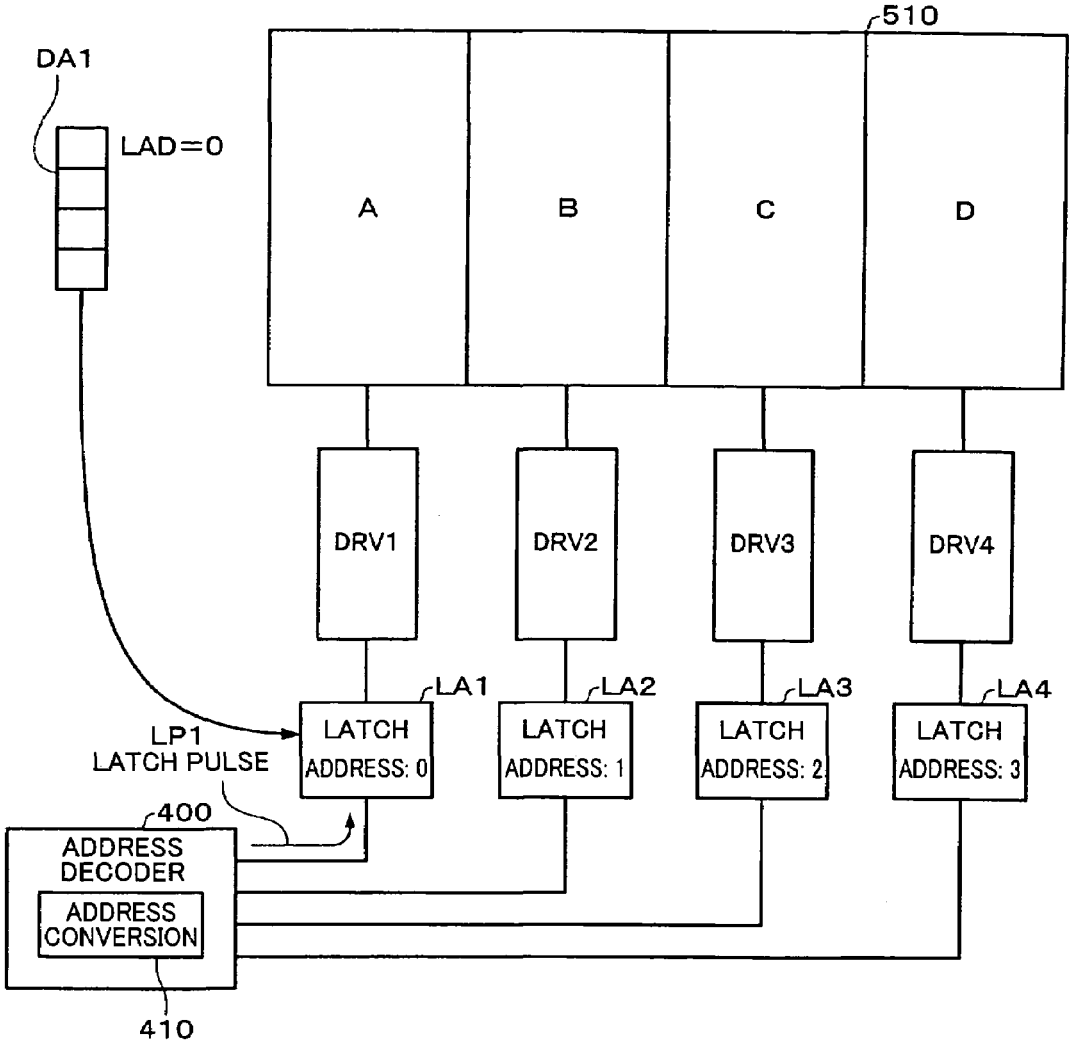
FIG. 17 is illustrative of a right-left inversion display according to this embodiment.

The right-left inversion display is described below. FIG. 17 is a block diagram illustrative of the right-left inversion display. FIG. 17 shows four data line driver sections DRV1 to DRV4, four latch circuits LA1 to LA4, and four display areas A to D respectively driven by the data line driver sections DRV1 to DRV4 for convenience of illustration. However, the present invention is not limited thereto. In the case of performing the normal display in the display driver including the address conversion circuit 410, when the wordline WL1 is selected, the display data DA1 is decoded by the decoder 100, and the decoded data is latched by the latch circuit LA1 in the same manner as in the above-described embodiment. In this case, the value of the latch address data LAD included in the wordline address information and the value of the address assigned to the latch circuit LA1 are "0", for example. Specifically, the address decoder 400 outputs the latch pulse LP1 to the latch circuit LA1 to which the address having the same value as the latch address data LAD is assigned. This causes the data line driver section DRV1 to drive the display area A of the display panel 510. The display areas A to D are displayed by causing the display data to be sequentially read from the display memory 200.

Figure 18:
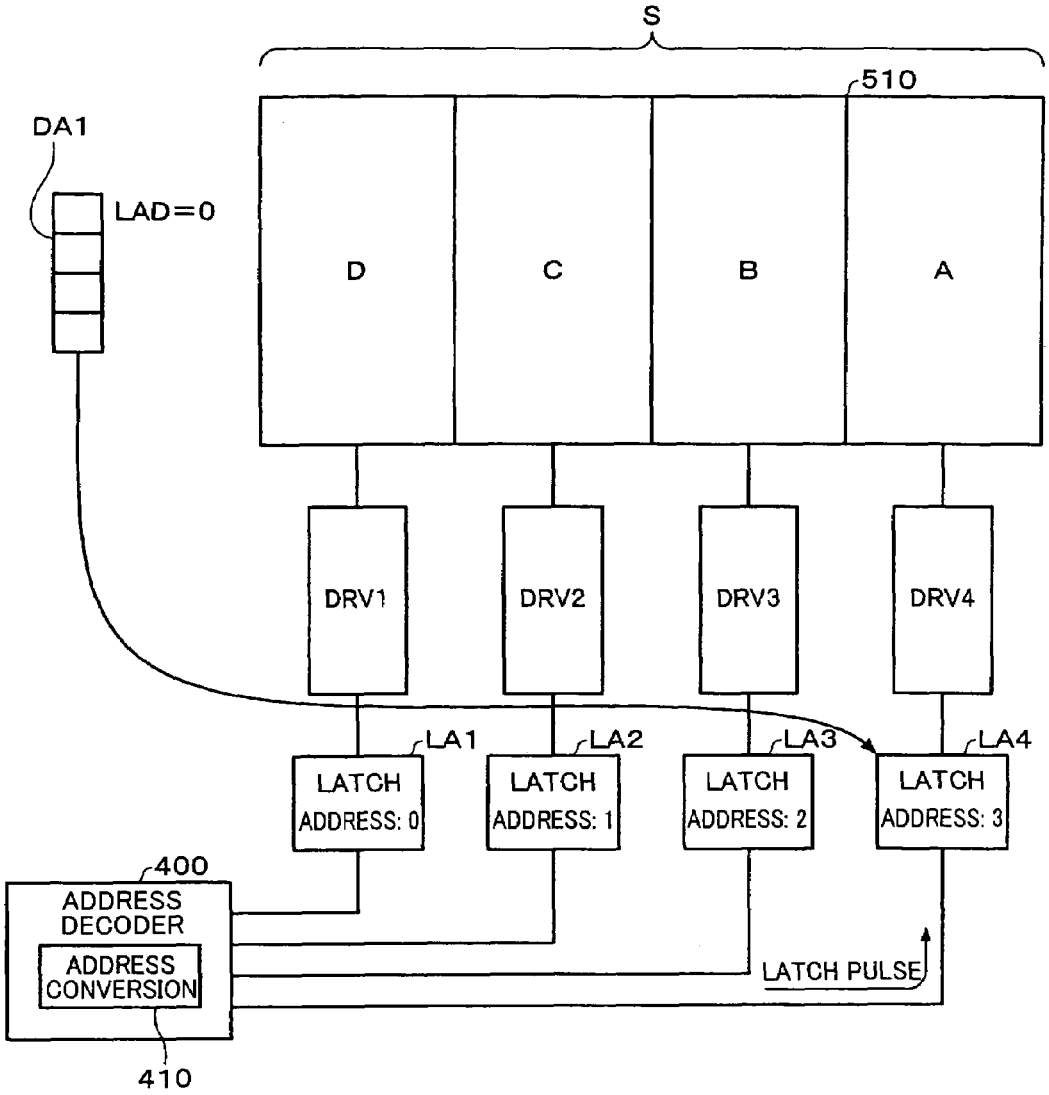
FIG. 18 is illustrative of a right-left inversion display according to this embodiment.

When performing the right-left inversion display, the latch pulse is output to the latch circuit determined based on the latch address data LAD when the display data DA1 is read and on the number of data lines of the display panel 510. FIG. 18 shows the case of performing the right-left inversion display for the display panel 510 shown in FIG. 17.

In the case of performing the right-left inversion display, when the wordline WL1 is selected, the display data DA1 is decoded by the decoder 100, and the decoded data is latched by the latch circuit LA4. In this case, the value of the latch address data LAD included in the wordline address information is "0" in the same manner as described above. However, according to FIG. 18, the address assigned to the latch circuit LA4 is "3", and the latch pulse is output from the address decoder 400 to the latch circuit LA4. This occurs due to the function of the address conversion circuit 410. In the case of performing the right-left inversion display, the address conversion circuit 410 selects the latch circuit LA4 from among the four latch circuits LA1 to LA4 based on the latch address data LAD and the number of data lines, and outputs the latch pulse to the latch circuit LA4. When the number of data lines of the display panel 510 is S (S is an integer greater than one), the calculation circuit 420 of the address conversion circuit 410 calculates "(S−1)−LAD" when selecting the latch circuit LA4, for example. In FIG. 18, "(4−1)−0=3" is obtained. The latch circuit LA4 to which the address value of "3" is assigned is selected based on the calculation result, whereby the latch pulse is input to the latch circuit LA4.

Specifically, the address of the latch circuit for performing the right-left inversion display can be obtained by subtracting the value of the latch address data LAD from the value (right-left inversion data in a broad sense) obtained by subtracting "1" from the number S of data lines. The right-left inversion display can be easily performed by performing the above-described processing for the display data sequentially read from the display memory 200.

Figure 19:
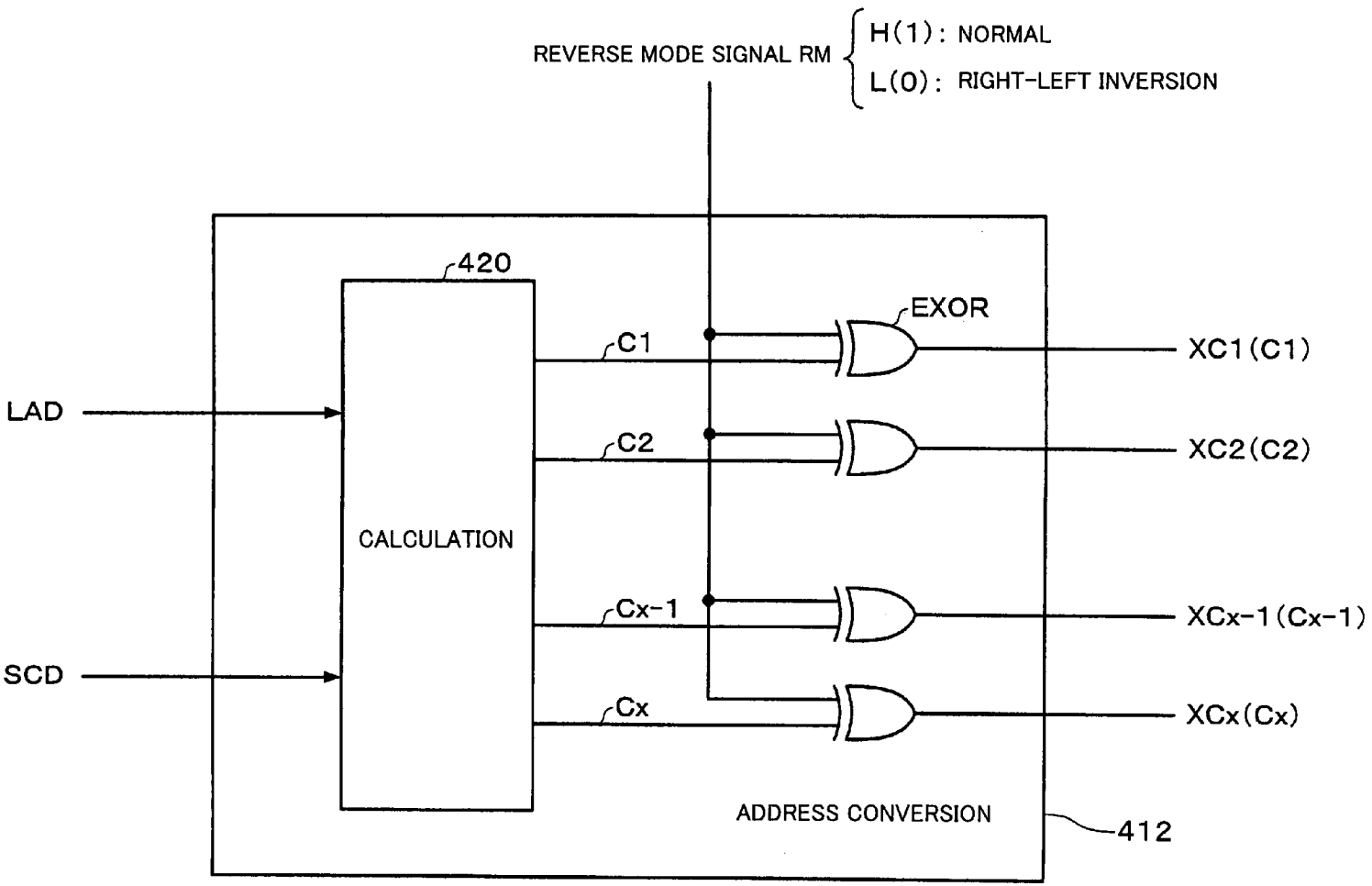
FIG. 19 shows another address conversion circuit according to this embodiment.

The right-left inversion display can also be easily realized by using an address conversion circuit 412 shown in FIG. 19. In the address conversion circuit 412 shown in FIG. 19, exclusive OR circuits EXOR are provided instead of the inverters provided in the address conversion circuit 410 shown in FIG. 12, for example. A reverse mode signal RM is input to one input of the exclusive OR circuits EXOR. The data C1 to Cx output from the calculation circuit 420 is input to the other input of the exclusive OR circuits EXOR. In this example, the reverse mode signal RM is set to a signal at the high level (or logical value "1") when performing the normal display, and is set to a signal at the low level (or logical value "0") when performing the right-left inversion display.

Since the reverse mode signal RM is set at the logical value "1" when performing the normal display, the logical value "I" is input to one input of the exclusive OR circuits EXOR. The output from the exclusive OR circuit EXOR to which the logical value "0" is input at the other input is set at the logical value "1". The output from the exclusive OR circuit EXOR to which the logical value "1" is input at the other input is set at the logical value "0". Specifically, since each exclusive OR circuit EXOR functions as an inverter, the address conversion circuit 412 has the same function as the address conversion circuit 410 shown in FIG. 12.

Since the reverse mode signal RM is set at the logical value "0" when performing the right-left inversion display, the logical value "0" is input to one input of the exclusive OR circuits EXOR. In this case, the output from each exclusive OR circuit EXOR is set at the logical value input to the other input of each exclusive OR circuit EXOR. For example, the output from the exclusive OR circuit EXOR to which the logical value "1" is input at the other input is set at the logical value "1". Specifically, the data C1 to Cx from the calculation circuit 420 is not reversed and output from the address conversion circuit 412.

The data output from the address conversion circuit 412 is output to the logic circuits AND of the address decoder 400 in the same manner as the address conversion circuit 410 shown in FIG. 11. However, when the reverse mode signal RM is set at the logical value "0", the unreversed data C1 to Cx is input to the logic circuits AND shown in FIG. 11. For example, when all the data C1 to Cx is set at the logical value "0", the output from the logic circuit AND to which the inverters INV3 are connected at all inputs is set at the logical value "1". Specifically, the output from the logic circuit AND connected with the latch circuit LAx is set at the logical value "1", whereby the latch circuit LAx is selected from among the latch circuits LA1 to LAx.

However, when all the data C1 to Cx is set at the logical value "0" when performing the normal display, since all the data XC1 to XCx which is the inversion data of the data C1 to Cx is set at the logical value "1", the output from the logic circuit AND connected with the latch circuit LA1 shown in FIG. 11 is set at the logical value "1". Specifically, when all the data C1 to Cx output from the address conversion circuit 410 is set at the logical value "0", the latch pulse is input to the latch circuit LA1.

In other words, the latch circuit to be selected is reversed in right and left in the direction X corresponding to the reverse mode signal RM, whereby the right-left inversion display can be easily performed. Moreover, since the address conversion circuit 412 can also perform calculation for performing the horizontal scroll display using the calculation circuit 420, the horizontal scroll display can be easily performed while performing the right-left inversion display.

According to the above-described embodiment and modification, the display data can be displayed on the display panel by arbitrarily selecting the latch circuits LA1 to LAx and driving the data line corresponding to the selected latch circuit without rewriting the display data in the display memory, for example. In the case where the position of the target pixel of the display data is changed in real time such as in the horizontal scroll display or the right-left inversion display, it is necessary to update the display data in the display memory in the comparative example each time the position of the pixel is changed, whereby control or the like is complicated and load is imposed on a processor or the like. However, in this embodiment and the modification, the horizontal scroll display or the right-left inversion display can be performed without rewriting the display data in the display memory.

4. Display Memory

Figure 20:
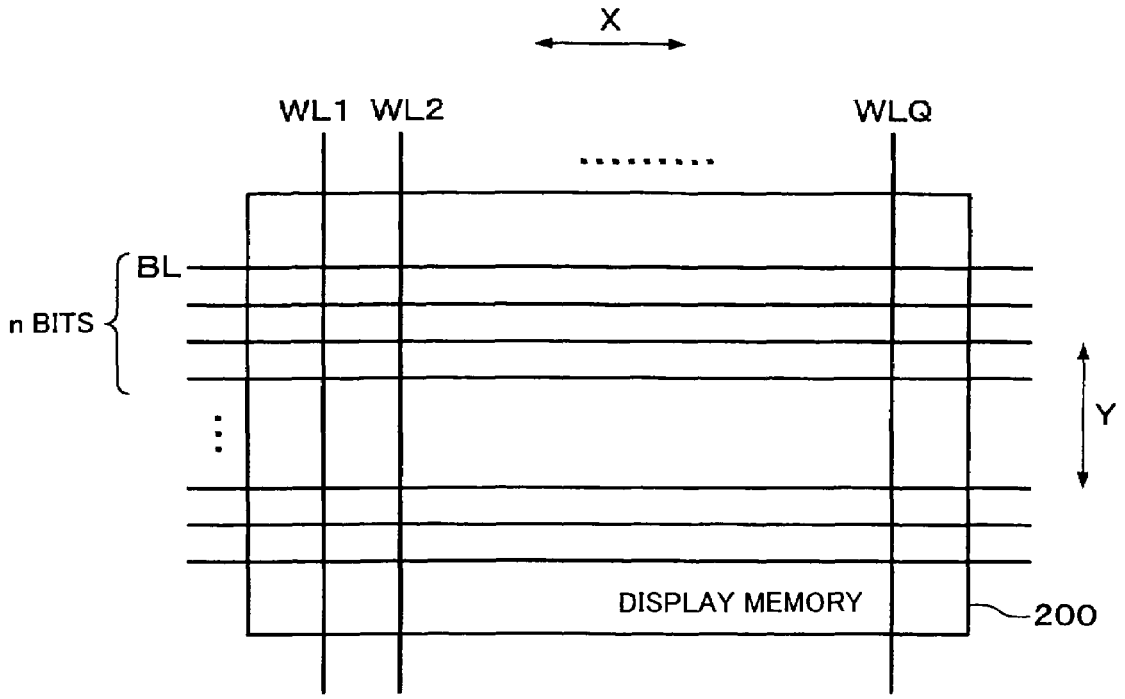
FIG. 20 shows a display memory according to this embodiment.

FIG. 20 shows the display memory 200. A plurality of bitlines BL are provided in the display memory 200. The bitlines BL are formed along the direction X. When the wordline WL1 is selected, n-bit data is output through the bitlines BL, for example.

Figure 21:
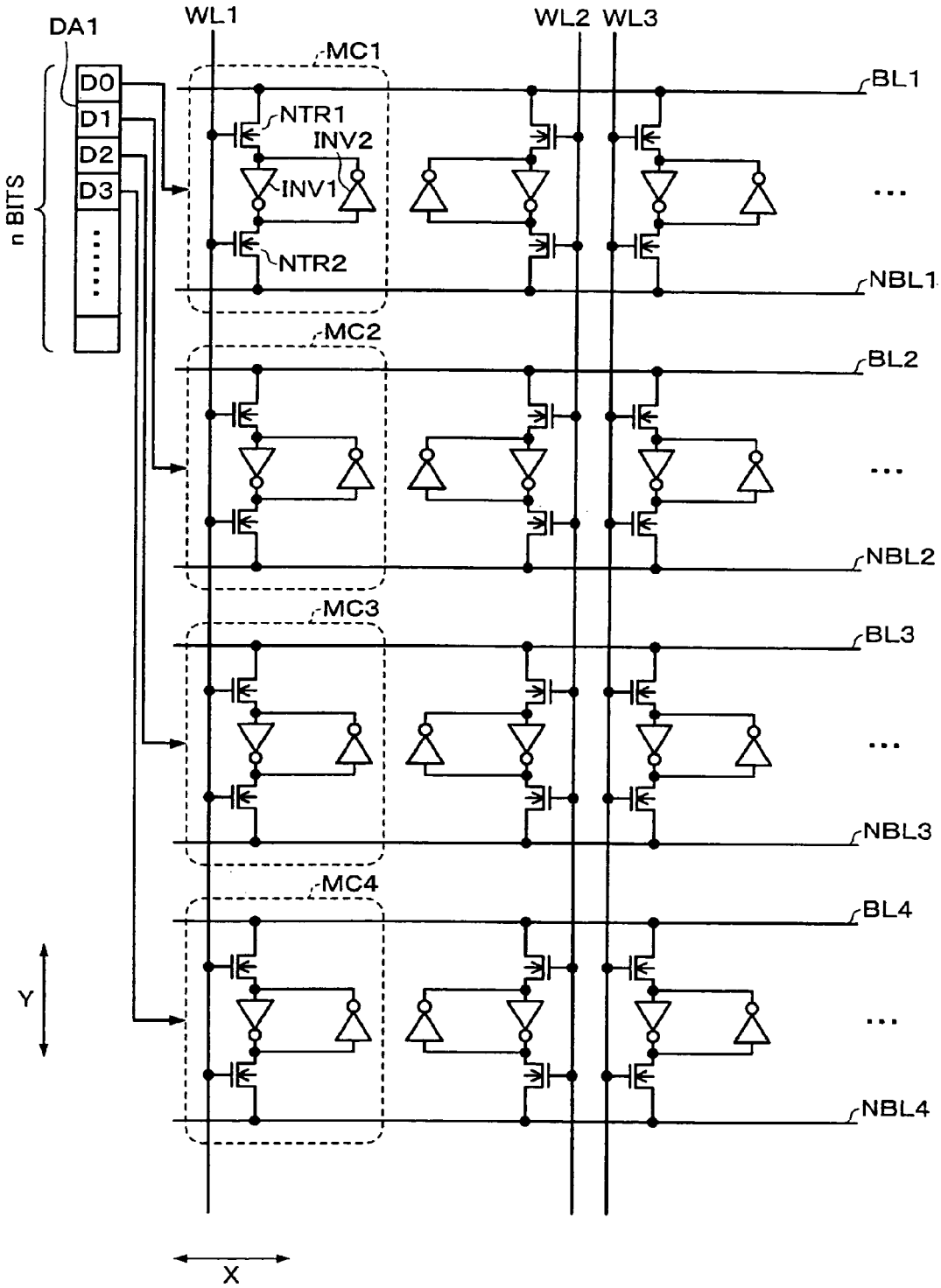
FIG. 21 shows a relationship between memory cells provided in a display memory according to this embodiment and display data.

FIG. 21 shows a relationship between a plurality of memory cells provided in the display memory 200 and the display data DA1. FIG. 21 shows a part of the display memory 200. An inversion signal obtained by reversing a signal input to each of bitlines BL1 to BL4 is input to each of bitlines NBL1 to NBL4, respectively. Each memory cell of the display memory 200 includes N-type transistors NTR1 and NTR2 and inverters INV1 and INV2. For example, data is read from and written into a memory cell MC1 through the bitlines BL1 and NBL1. Specifically, since data is input to and output from the memory cell MC1 through single system lines, the memory cell MC1 is called a one-port memory cell.

When the wordline WL1 is selected, the N-type transistors NTR1 and NTR2 of the memory cell MC1 are turned ON. This enables data to be read from the memory cell MC1 or data to be written into the memory cell MC1. The display data DA1 is stored in the display memory 200 in which such one-port memory cells are arranged. The data D0 of the n-bit display data DA1 is stored in the memory cell MC1, for example. The data D1 of the n-bit display data DA1 is stored in the memory cell MC2, for example. The data D2 and D3 of the display data DA1 is respectively stored in the memory cells MC3 and MC4, for example.

The display data DA1 stored in the display memory 200 is output to the decoder 100 by selecting the wordline WL1. For example, the data D0 of the display data DA1 can be read by reading outputs from the bitlines BL1 and NBL1 using a sense amplifier or the like. The data D2 and D3 of the display data DA1 can be read by reading outputs from the bitlines BL2 to BL4 and the bitlines NBL2 to NBL4.

5. Comparison with Comparative Example

Figure 22:
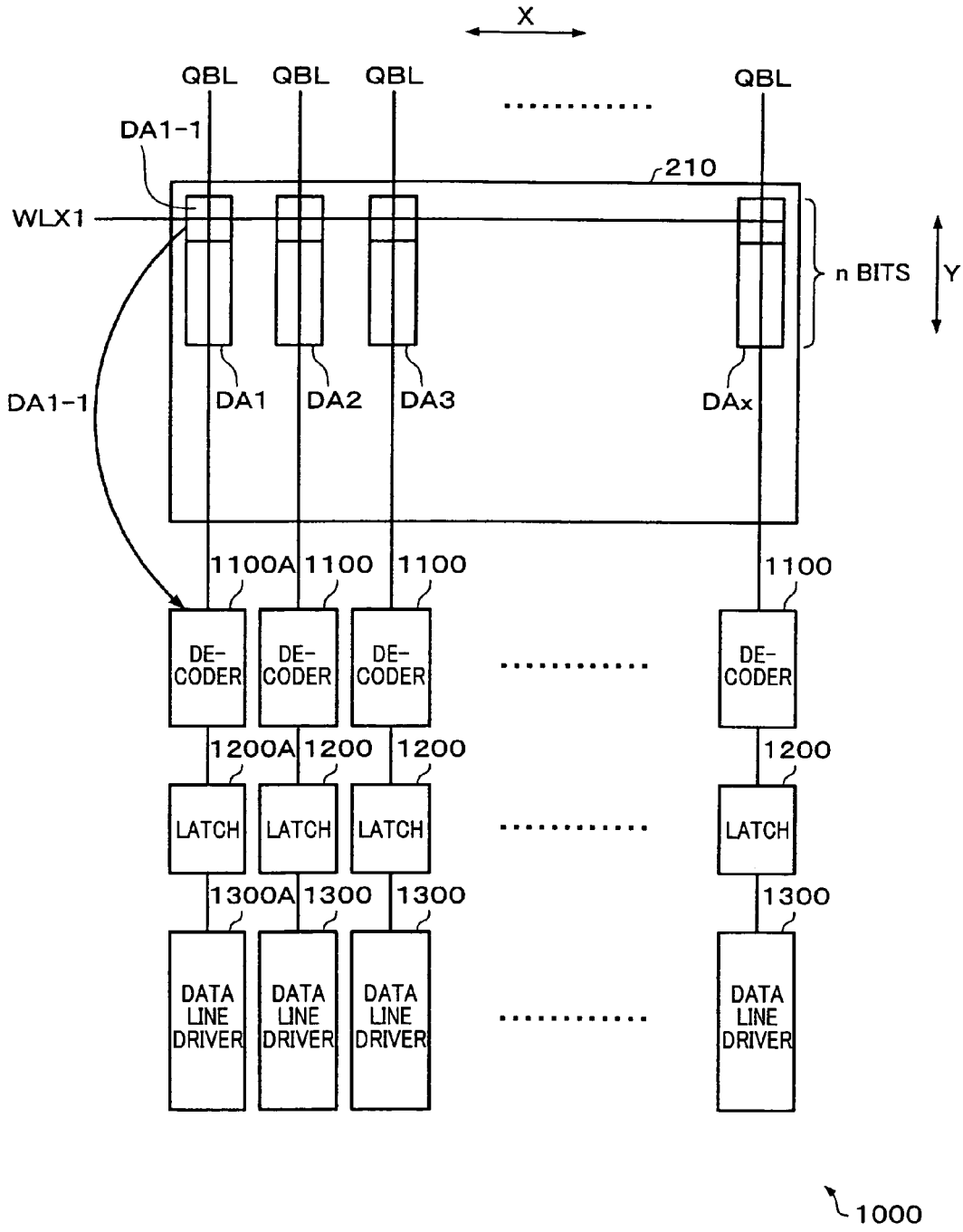
FIG. 22 shows a display driver in a comparative example.

FIG. 22 shows a display driver 1000 in a comparative example. The display memory 1000 includes a display memory 210, a plurality of decoders 1100, a plurality of latch circuits 1200, and a plurality of data line driver sections 1300, for example. The decoder 1100 includes a grayscale decoder which decodes grayscale data, and a multi-line select drive decoder which generates data which selects a drive voltage of the data line driver section 1300, for example.

A wordline is formed in the display memory 210 along the direction X. A plurality of bitlines QBL are formed in the display memory 210 along the direction Y, and are arranged along the direction X. A plurality of wordlines WLX are arranged in the display memory 210 along the direction Y. FIG. 22 shows one wordline WLX1 for convenience of description.

When the wordline WLX1 is selected, 1-bit data DA 1-1 stored in a memory cell connected with the wordline WLX1 is output to a decoder 1100A from the n-bit display data DA1 stored in the display memory 210. 1-bit data stored in each memory cell connected with the wordline WLX1 is output from n-bit display data DA2 to DAx (x is an integer greater than one) to the corresponding decoder 1100 through each bitline QBL.

Specifically, 1-bit display data is output to each decoder 1100 by selecting one wordline. In the case where the amount of information necessary for the decoder 1100 to decode the display data is n bits, a latch circuit or the like may be provided to each decoder 1100, and n-bit data may be stored in the decoder 1100 by selecting the wordlines n times.

However, as the resolution of the display panel is increased, the number of decoders 1100 is increased accompanying an increase in the number of data lines. An increase in the number of decoders 1100 increases the chip area, whereby manufacturing cost is increased. In the display driver 10 in this embodiment, since one decoder 100 outputs the drive voltage select data to the latch circuits LA1 to LAx, the chip area can be significantly reduced. A reduction in the chip area reduces manufacturing cost and increases the degrees of freedom of the layout.

Figure 23:
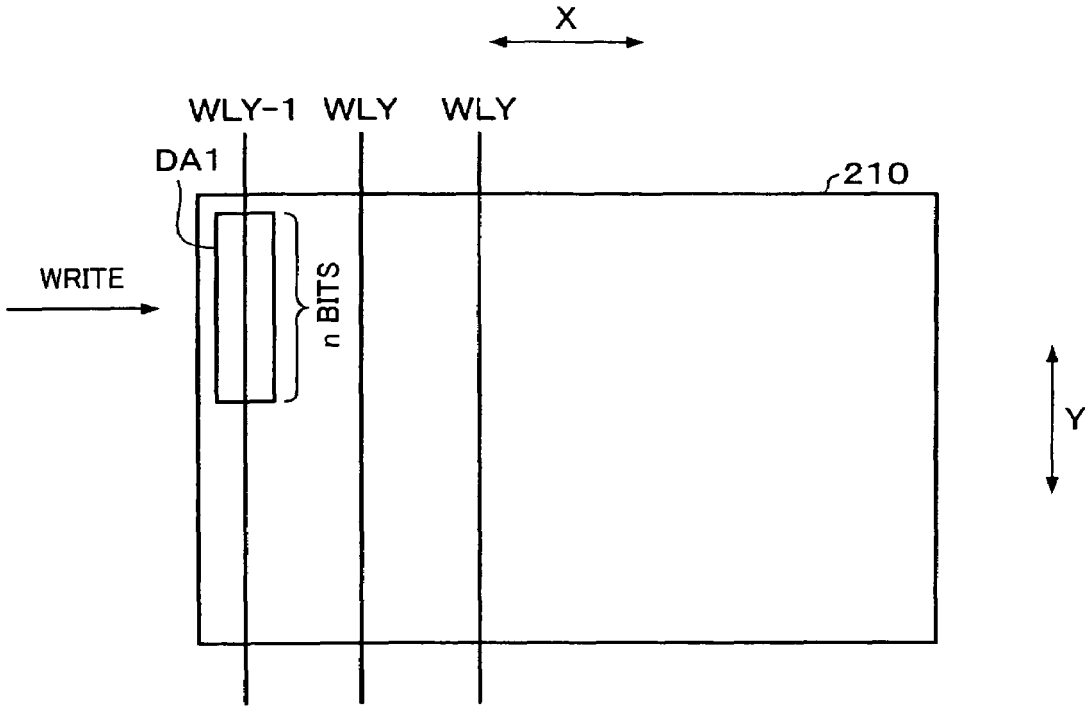
FIG. 23 shows a display memory in the comparative example.

The operation of writing display data into the display memory 210 of the display driver 1000 in the comparative example is described below. FIG. 23 shows the display memory 210 in the comparative example. The display memory 210 includes a plurality of wordlines WLY in addition to the bitlines QBL. The wordline WLY is formed in the display memory 210 along the direction Y. In the case of writing the n-bit display data DA1 into the display memory 210, the wordline WLY-1 is selected, whereby the display data DA1 is written into the memory cells connected with the wordline WLY-1. Specifically, data of each bit of the n-bit display data DA1 is stored in the memory cells arranged along the direction Y. The arrangement of the memory cells in which the data of each bit of the display data DA1 is stored is the same as that for the n-bit display data DA1 stored in the display memory 200 in this embodiment.

Specifically, the display data DA1 can be written into the display memory 200 in the same manner as in the case of using the display driver 1000 in the comparative example. For example, a memory control program created for using the display driver 1000 in the comparative example may be easily applied to the display driver 10 in this embodiment. The design period can be reduced by providing compatibility with the display driver 1000 in the comparative example as to the writing method of the display data into the display memory.

In the display memory 200 in this embodiment, the amount of data which can be stored in unit area of the display memory is greater than that of the display memory 210 in the comparative example. Specifically, the layout size per bit of the memory cell is reduced, and the number of interconnects provided in the display memory is also reduced. Therefore, the display driver 10 including the display memory 200 enables the chip area to be significantly reduced in comparison with the display driver 1000 in the comparative example, whereby manufacturing cost is reduced.

Figure 24:
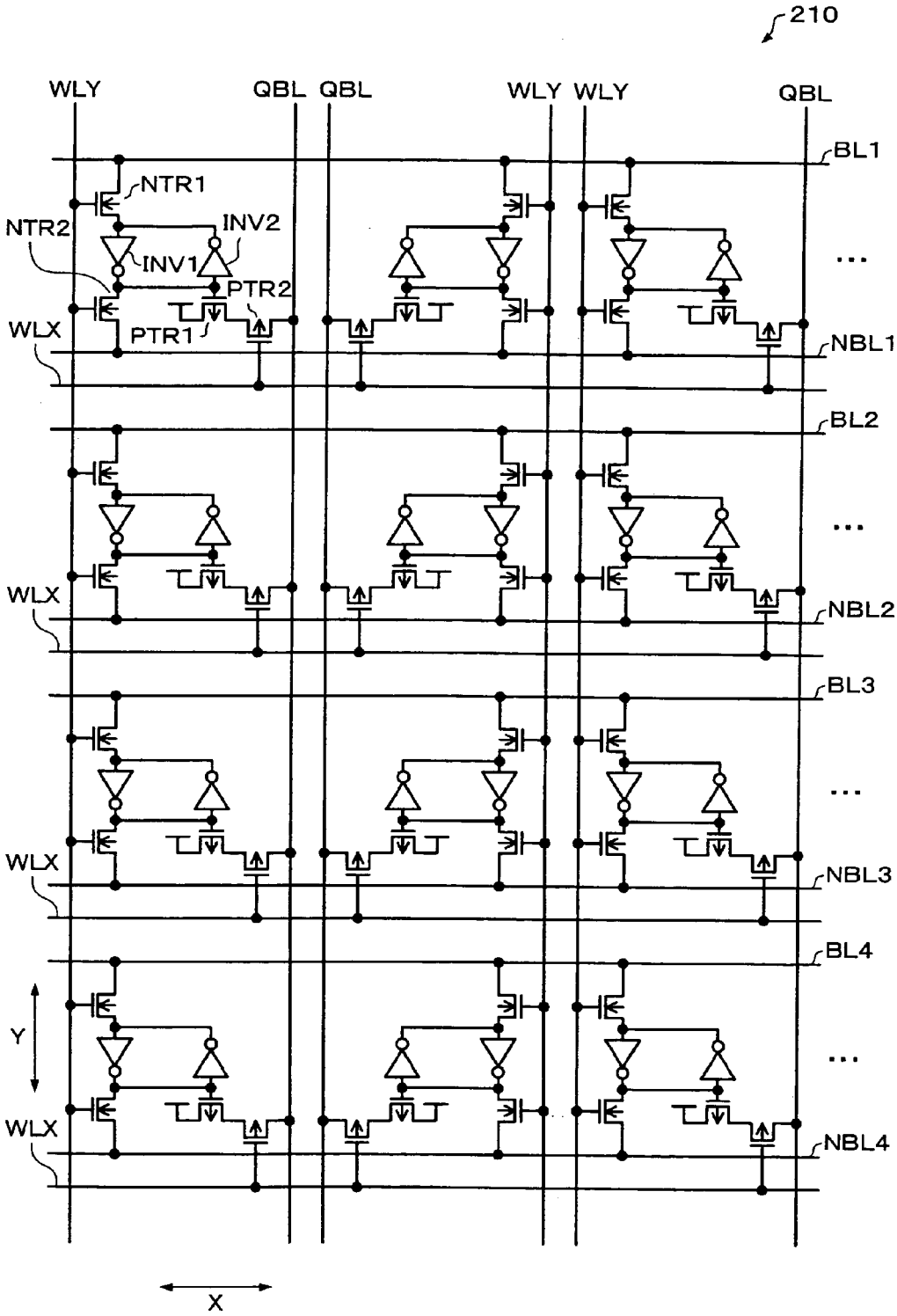
FIG. 24 is a circuit diagram showing a part of the display memory in the comparative example.

In order to describe the above-described effect, FIG. 24 provides a circuit diagram showing a part of the display memory 210 in the comparative example. The wordlines WLY, the bitlines QBL, and the wordlines WLX are provided in the display memory 210. The bitlines BL and NBL are formed in the display memory 210 along the direction X. FIG. 24 shows only the bitlines BL1 to BL4 and NBL1 to NBL4. In the display memory 210, a memory cell which can store 1-bit data includes N-type transistors NTR1 and NTR2 and P-type transistors PTR3 and PTR4. The memory cell of the display memory 210 includes inverters INV1 and INV2.

When writing the display data into the display memory 210, the wordline WLY formed along the direction Y is selected, and the data is written into the memory cell through the bitlines BL and NBL formed along the direction X. When reading the display data from the display memory 210, the wordline WLX formed along the direction X is selected, and the data stored in the memory cell is output through the bitline QBL formed along the direction Y. In the case where the data is input to one memory cell through two systems consisting of the bitlines BL1 and NBL1, and the data stored in the memory cell is output through one system consisting of the bitline QBL which is another system of the bitlines BL1 and NBL1, such a memory cell is called a 1.5-port memory cell.

The P-type transistors PTR3 and PTR4 provided in the 1.5-port memory cell in the comparative example are not provided in the one-port memory cell shown in FIG. 21. The wordlines WLX and the bitlines QBL provided in the display memory 210 in the comparative example are not provided in the display memory 200 in this embodiment. Specifically, in the case where the display memory 200 and the display memory 210 can store the same amount of data, the display memory 200 in this embodiment enables the chip size to be significantly reduced in comparison with the display memory 210 in the comparative example.

6. Modification

The display driver 10 shown in FIG. 1 includes the decoder 100, the display memory 200, the control circuit 300, the address decoder 400, the data line driver sections DRV, and the latch circuits LA1 to LAx. However, the present invention is not limited thereto. For example, some of the above-described circuits may be omitted from the display driver 10, or the display driver 10 may include another circuit. For example, the display memory 200, the control circuit 300, or the address decoder 400 may be omitted from the display driver 10.

The decoder 100 shown in FIG. 1 includes the FRC decoder 110 and the MLS decoder 120. However, the present invention is not limited thereto. For example, the FRC decoder 110 or the MLS decoder 120 may be omitted from the decoder 100.

Figure 25:
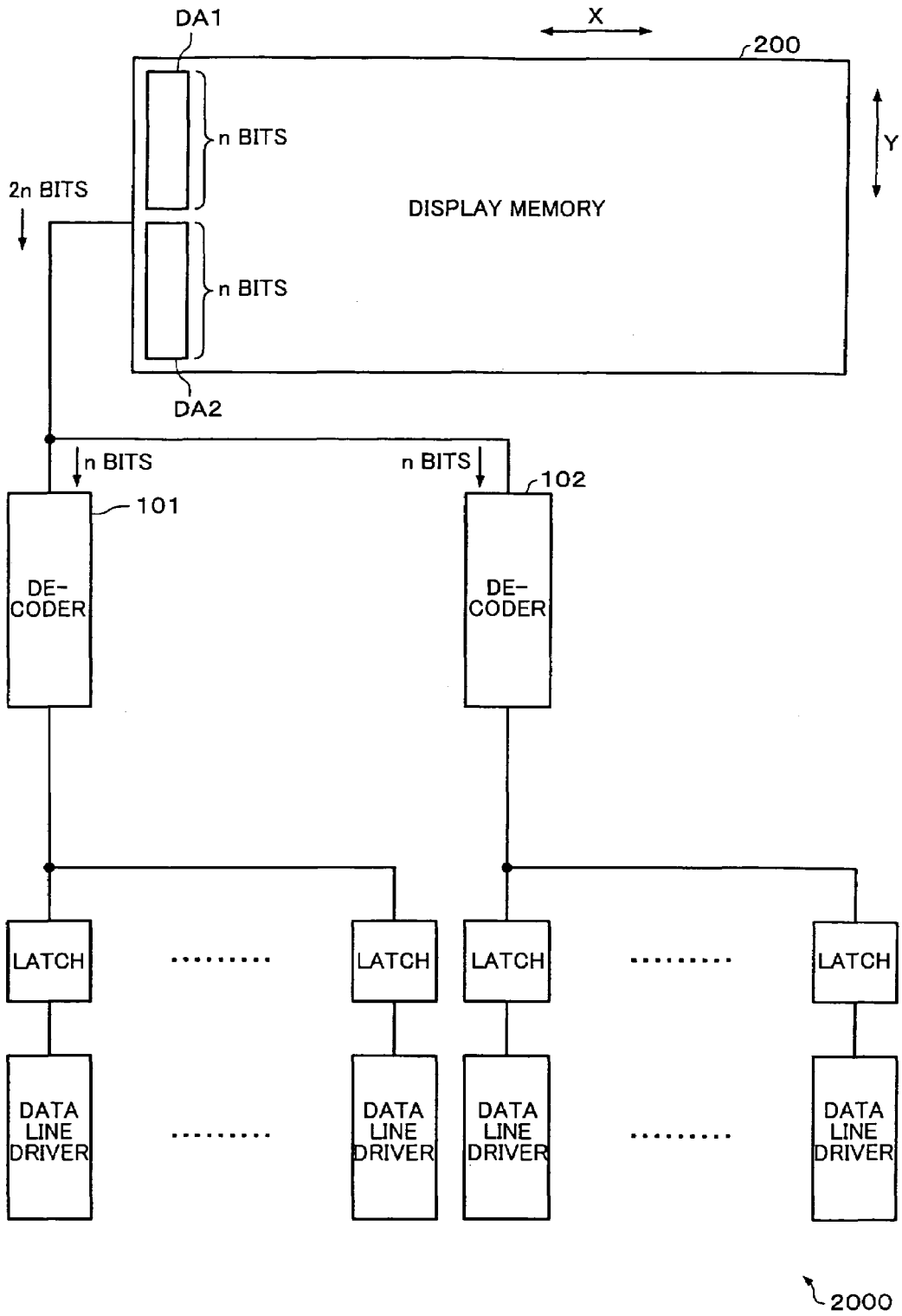
FIG. 25 shows a display driver according to a modification of this embodiment.

FIG. 25 shows a modification of the display driver 10 in this embodiment. A display driver 2000 which is a modification of this embodiment includes the display memory 200, decoders 101 and 102, the address decoder 400, a plurality of latch circuits, and a plurality of data line driver sections. However, the present invention is not limited thereto. For example, the display driver 2000 may have a configuration in which the display memory 200 is omitted. 2n-bit data consisting of the n-bit display data DA1 and the n-bit display data DA2 is read from the display memory 200. The n-bit display data DA1 of the 2n-bit data is output to the decoder 101, and the n-bit display data DA2 is output to the decoder 102, for example. The decode processing of the display data cannot be completed within one display period as the resolution of the display panel is increased, whereby the display state of the display panel may be affected. However, since the decode processing of the display data can be distributed over the decoders 101 and 102 by using the display driver 2000, the display data can be displayed on the display panel at a high image quality even if the display panel has a higher resolution. Moreover, the horizontal scroll display or the right-left inversion display can be performed by the functions of the address decoder 400 and the address conversion circuit 410.

7. Electronic Instrument

Figure 26:
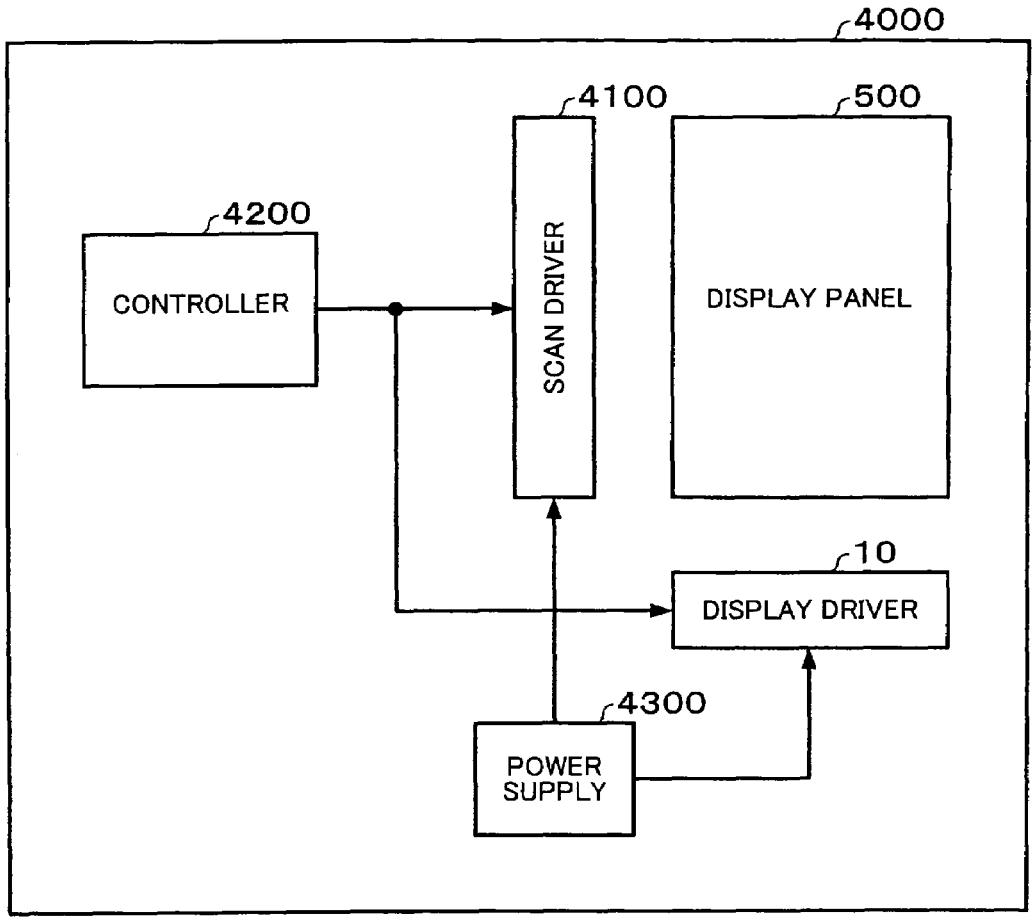
FIG. 26 shows an electronic instrument according to this embodiment.

FIG. 26 is a block diagram showing a configuration of an electronic instrument including the display driver 10 according to this embodiment. An electronic instrument 4000 shown in FIG. 27 includes the display driver 10, the display panel 500, a scan driver 4100 which drives scan lines of the display panel 500, a controller 4200 which supplies a control signal and the like to the display driver 10 and the scan driver 4100, and a power supply 4300. However, the present invention is not limited thereto. For example, the controller 4200 or the power supply may be omitted, or another device may be additionally provided.

Since the display driver 10 is provided in the electronic instrument 4000, manufacturing cost of the electronic instrument 4000 can be reduced.

The present invention is not limited to the above-described embodiments, and various modifications can be made within the scope of the invention. For example, any term (such as FRC decoder, FRCROM, MLS decoder, select signal which selects the wordline, or filp flop) cited with a different term having broader or the same meaning (such as grayscale decoder, grayscale ROM, multi-line select drive decoder, address information on the display memory, or latch circuit) at least once in this specification and drawings can be replaced by the different term in any place in this specification and drawings.

Although only some embodiments of the present invention have been described in detail above, those skilled in the art will readily appreciate that many modifications are possible in the embodiments without materially departing from the novel teachings and advantages of this invention. Accordingly, all such modifications are intended to be included within scope of this invention.

What is claimed is:

1. A display driver, comprising:

a decoder that decodes a first n-bit (n is an integer greater than one) display data sequentially input from a display memory in units of n bits;

a plurality of latch circuits that latch a second data decoded by the decoder;

an address decoder, including an address conversion circuit, that generates a latch pulse for the plurality of latch circuits to latch output from the decoder;

a control circuit that controls the display memory and the address decoder; and a plurality of data line driver sections that drive data lines of a display panel based on the second data, the control circuit controlling reading the first n-bit display data from the display memory and outputting to the decoder by performing wordline control for the display memory once, the decoder decoding the first n-bit display data, and sequentially outputting the second data to the plurality of latch circuits, the control circuit outputting display memory address information to the display memory and the address decoder, the display memory address information being address information for reading the first n-bit display data from the display memory, latch address data that indicates a storage destination of the second data being set based on the display memory address information;

the address decoder selecting a first one of the plurality of latch circuits based on the display memory address information and storage destination designation information including horizontal scroll data, arbitrarily set from the control circuit, and outputting the latch pulse to the one of the plurality of latch circuits, the address conversion circuit receiving the horizontal scroll data and the latch address data, and each of the plurality of data line driver sections driving corresponding one of the data lines after the second data has been stored in the plurality of latch circuits, wherein:

when horizontally scrolling an image on the display panel in a first direction, the address conversion circuit performing addition processing of the horizontal scroll data and the latch address data, selecting a first one of the plurality of latch circuits based on a processing result, and outputting the latch pulse to the first one of the plurality of latch circuits, and when horizontally scrolling an image on the display panel in a second direction opposite to the first direction, the address conversion circuit performing subtraction processing of the horizontal scroll data and the latch address data, selecting a second one of the plurality of latch circuits based on a processing result, and outputting the latch pulse to the second one of the plurality of latch circuits.

2. The display driver as defined in claim 1, the storage destination designation information including right-left inversion data, and the address conversion circuit receiving the right-left inversion data and the latch address data, performing subtraction processing of the right-left inversion data and the latch address data, selecting a first one of the plurality of latch circuits based on a processing result, and outputting the latch pulse to the first one of the plurality of latch circuits.

3. The display driver as defined in claim 2, the decoder including a multi-line select drive decoder; and the multi-line select drive decoder generating drive voltage select data for selecting a drive voltage from among a plurality of drive voltages for a multi-line select drive of scan lines based on display data for m (m is an integer greater than one) pixels included in the first n-bit display data, and outputting the drive voltage select data to the plurality of latch circuits.

4. The display driver as defined in claim 3, the first n-bit display data being read from the display memory in synchronization with one of a rising edge and a falling edge of a clock signal from the control circuit, and the address decoder outputting the latch pulse in synchronization with the other of the rising edge and the falling edge of the clock signal.

5. An electronic instrument, comprising:

the display driver as defined in claim 3;

a display panel;

a scan driver that drives scan lines of the display panel;

a controller that controls the display driver and the scan driver; and a power supply circuit.

6. The display driver as defined in claim 2, the decoder including a grayscale decoder, and the grayscale decoder determining a display pattern of a pixel indicated by the first n-bit display data based on the first n-bit display data and frame information.

7. The display driver as defined in claim 1, the storage destination designation information including right-left inversion data, the address conversion circuit receiving the right-left inversion data and the latch address data, and performing subtraction processing of the right-left inversion data and the latch address data, when performing a horizontal scroll display of an image on the display panel, the address decoder outputting the latch pulse to a one of the plurality of latch circuits selected based on a result of addition processing or subtraction processing of the horizontal scroll data and the latch address data, and when performing a right-left inversion display of an image on the display panel, the address decoder outputting the latch pulse to the first one of the plurality of latch circuits selected based on a result of subtraction processing of the right-left inversion data and the latch address data.

8. The display driver as defined in claim 1, the decoder including a multi-line select drive decoder; and the multi-line select drive decoder generating drive voltage select data for selecting a drive voltage from among a plurality of drive voltages for a multi-line select drive of scan lines based on display data for m (m is an integer greater than one) pixels included in the first n-bit display data, and outputting the drive voltage select data to the plurality of latch circuits.

9. The display driver as defined in claim 8, each of the plurality of data line driver sections selecting a data line drive voltage from among the drive voltages based on the drive voltage select data stored in the plurality of latch circuits, and the plurality of data line driver sections driving the data lines by using the data line drive voltage.

10. The display driver as defined in claim 8, the first n-bit display data being read from the display memory in synchronization with one of a rising edge and a falling edge of a clock signal from the control circuit, and the address decoder outputting the latch pulse in synchronization with the other of the rising edge and the falling edge of the clock signal.

11. The display driver as defined in claim 1, the decoder including a multi-line select drive decoder; and the multi-line select drive decoder generating drive voltage select data for selecting a drive voltage from among a plurality of drive voltages for a multi-line select drive of scan lines based on display data for m (m is an integer greater than one) pixels included in the first n-bit display data, and outputting the drive voltage select data to the plurality of latch circuits.

12. The display driver as defined in claim 1, the decoder including a grayscale decoder, and the grayscale decoder determining a display pattern of a pixel indicated by the first n-bit display data based on the first n-bit display data and frame information.

13. The display driver as defined in claim 12, the grayscale decoder outputting data "0" or "1" to at least one of the plurality of latch circuits based on the display pattern.

14. The display driver as defined in claim 12, the decoder further including a multi-line select drive decoder for a multi-line select drive method which simultaneously selecting and driving m (m is an integer greater than one) scan lines, and the multi-line select drive decoder outputting drive voltage select data for selecting a data line drive voltage for driving the data lines to the plurality of latch circuits based on the display pattern.

15. The display driver as defined in claim 14, each of the plurality of data line driver sections selecting the data line drive voltage from among a plurality of types of drive voltages for a multi-line select drive of scan lines based on the drive voltage select data stored in one of the plurality of latch circuits, and the plurality of data line driver sections driving the data lines by using the data line drive voltage.

16. The display driver as defined in claim 15, a grayscale of each of m pixels in display data extracted from the first n-bit display data being indicated by k-bit (k is an integer greater than one) grayscale data, the grayscale decoder including a grayscale ROM for determining a grayscale pattern that indicates two types of display states based on the k-bit grayscale data and the frame information, the grayscale decoder determining the grayscale pattern for each of the m pixels based on the grayscale ROM, and outputting in-bit display data which indicates a one of the display states of each of the m pixels by "0" or "1" based on the determined grayscale pattern to the multi-line select drive decoder, and the multi-line select drive decoder generating the drive voltage select data based on the in-bit display data, and outputting the drive voltage select data to the plurality of latch circuits.

17. The display driver as defined in claim 1, the decoder including a grayscale decoder, and the grayscale decoder determining a display pattern of a pixel indicated by the first n-bit display data based on the first n-bit display data and frame information.

18. The display driver as defined in claim 1, the first n-bit display data being read from the display memory in synchronization with one of a rising edge and a falling edge of a clock signal from the control circuit, and the address decoder outputting the latch pulse in synchronization with the other of the rising edge and the falling edge of the clock signal.

19. An electronic instrument, comprising:

the display driver as defined in claim 1;

a display panel;

a scan driver that drives scan lines of the display panel;

a controller that controls the display driver and the scan driver; and a power supply circuit.

20. The display driver as defined in claim 1, wherein:

the address conversion circuit performs calculation processing of the display memory address information and the storage destination designation information, and selects one of the plurality of latch circuits based on a result of the calculation processing.

21. The display driver as defined in claim 1, the control circuit outputting a wordline select signal to the display memory in synchronization with a first edge of a clock signal, the first edge being one of a rising edge and a falling edge of the clock signal, the wordline select signal being a signal for reading the first n-bit display data from the display memory, the address decoder outputting the latch pulse in synchronization with a second edge of the clock signal, the second edge being another of the rising edge and the falling edge of the clock signal, the decoder performing decode processing in a period between the first edge and the second edge.

* * * * *